US009239203B2

(12) United States Patent
Jarboe et al.

(10) Patent No.: US 9,239,203 B2
(45) **Date of Patent: *Jan. 19, 2016**

(54) MODULAR FIREARM STOCK SYSTEM

(71) Applicant: RA Brands, L.L.C., Madison, NC (US)

(72) Inventors: Michael Brent Jarboe, Rineyville, KY (US); Gregory Phillip Baradat, Lakewood, WA (US); Gregory A. Dennison, Louisville, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/967,722

(22) Filed: Aug. 15, 2013

(65) Prior Publication Data

US 2013/0326924 A1 Dec. 12, 2013

Related U.S. Application Data

(60) Continuation of application No. 13/337,459, filed on Dec. 27, 2011, now Pat. No. 8,522,465, which is a division of application No. 12/640,531, filed on Dec. 17, 2009, now abandoned.

(60) Provisional application No. 61/184,630, filed on Jun. 5, 2009.

(51) Int. Cl.
*F41A 11/02* (2006.01)
*F41A 21/48* (2006.01)
(Continued)

(52) U.S. Cl.
CPC . *F41A 21/48* (2013.01); *F41A 3/18* (2013.01); *F41A 9/71* (2013.01); *F41A 11/02* (2013.01); *F41C 23/04* (2013.01); *F41C 23/16* (2013.01)

(58) Field of Classification Search
CPC ..... F41A 11/02; F41A 15/14
USPC ..... 42/25, 46, 47
See application file for complete search history.

(56) References Cited

U.S. PATENT DOCUMENTS 543,138 A 7/1895 Murray
1,315,215 A 9/1909 Davidson
(Continued)

FOREIGN PATENT DOCUMENTS

DE 1 213 303 3/1966
DE 3743 092 7/1988
(Continued)

OTHER PUBLICATIONS

A.M.S. Design Nemisis Bolt-Action .50 BMG Rifle, Oct. 4, 2010, 2 pages, Granite Arms, http://web.archive.org/web/20070829231846/http://www.granitearms.com.Nemisis-50BM and also.
(Continued)

*Primary Examiner* — Reginald Tillman, Jr.
(74) *Attorney, Agent, or Firm* — Womble Carlyle Sandridge & Rice, LLP

(57) ABSTRACT

A modular firearm is disclosed. The firearm that can be configured to operate using ammunition of different calibers via interchangeability of only a few parts. The firearm includes a foldable butt stock assembly for quickly and easily converting the firearm from an extended operating configuration to a compact transport configuration, and vice-versa. Additionally, the firearm includes a modular hand guard assembly having multiple mounting platforms for accommodating a variety of different accessories.

11 Claims, 18 Drawing Sheets

(51) Int. Cl.

| | |
|---|---|
| ***F41A 3/18*** | (2006.01) |
| ***F41A 9/71*** | (2006.01) |
| ***F41C 23/04*** | (2006.01) |
| ***F41C 23/16*** | (2006.01) |

(56) References Cited

U.S. PATENT DOCUMENTS

| | | | | |
|---|---|---|---|---|
| 1,407,633 | A * | 2/1922 | Burton | 42/50 |
| D136,041 | S | 7/1943 | Reising | |
| 2,374,621 | A | 4/1945 | Reising | |
| 2,422,853 | A * | 6/1947 | Reising | 42/16 |
| 2,985,248 | A | 7/1959 | Sawin | |
| 2,900,877 | A | 8/1959 | McClenahan | |
| 3,137,958 | A | 6/1964 | Lewis et al. | |
| 3,256,632 | A | 6/1966 | Beretta | |
| 3,267,601 | A | 8/1966 | Roy | |
| 3,348,328 | A | 10/1967 | Roy | |
| 3,369,316 | A | 2/1968 | Miller | |
| 3,442,042 | A | 5/1969 | Gilbert | |
| 3,593,452 | A | 7/1971 | Pekarek | |
| 3,742,638 | A * | 7/1973 | Archer | 42/25 |
| 3,745,686 | A * | 7/1973 | Koon, Jr. | 42/16 |
| 3,798,819 | A | 3/1974 | Hillberg | |
| 3,846,928 | A | 11/1974 | Ruger et al. | |
| 4,058,922 | A | 11/1977 | Elbe et al. | |
| 4,069,414 | A | 1/1978 | Bell | |
| 4,098,016 | A | 7/1978 | Foote | |
| 4,169,329 | A | 10/1979 | Atchisson | |
| 4,220,071 | A | 9/1980 | Seiderman | |
| 4,231,177 | A | 11/1980 | Foote | |
| 4,327,626 | A | 5/1982 | McQueen | |
| 4,430,822 | A | 2/1984 | Fromming et al. | |
| 4,515,064 | A | 5/1985 | Hohrein | |
| 4,653,210 | A * | 3/1987 | Poff, Jr. | 42/16 |
| 4,735,007 | A | 4/1988 | Gal | |
| 4,766,800 | A | 8/1988 | Miller et al. | |
| 4,788,785 | A | 12/1988 | White | |
| 5,046,275 | A | 9/1991 | Brown | |
| 5,173,564 | A | 12/1992 | Hammond, Jr. | |
| 5,209,215 | A | 5/1993 | Morrison | |
| 5,228,887 | A * | 7/1993 | Mayer | 42/75.02 |
| 5,305,539 | A | 4/1994 | Von Kuster | |
| 5,343,650 | A | 9/1994 | Swan | |
| 5,367,812 | A | 11/1994 | Lautrec | |
| 5,410,833 | A | 5/1995 | Paterson | |
| 5,410,834 | A | 5/1995 | Benton et al. | |
| 5,557,872 | A | 9/1996 | Langner | |
| 5,778,588 | A | 7/1998 | Allen, III et al. | |
| 5,827,992 | A | 10/1998 | Harris et al. | |
| 5,900,577 | A | 5/1999 | Robinson et al. | |
| 6,070,352 | A | 6/2000 | Daigle | |
| 6,374,528 | B1 | 4/2002 | Davis et al. | |
| 6,490,822 | B1 | 12/2002 | Swan | |
| 6,499,245 | B1 | 12/2002 | Swan | |
| 6,591,533 | B2 | 7/2003 | Wygant | |
| 6,651,371 | B2 | 11/2003 | Fitzpatrick et al. | |
| 6,732,465 | B2 | 5/2004 | Strayer | |
| 6,792,711 | B2 | 9/2004 | Battaglia | |
| 6,854,206 | B2 | 2/2005 | Oz | |
| 6,874,267 | B2 | 4/2005 | Fitzpatrick et al. | |
| 6,895,708 | B2 | 5/2005 | Kim et al. | |
| 6,901,691 | B1 | 6/2005 | Little | |
| 6,925,744 | B2 | 8/2005 | Kincel | |
| 7,121,035 | B2 | 10/2006 | Greer | |
| 7,152,355 | B2 | 12/2006 | Fitzpatrick et al. | |
| 7,287,456 | B2 | 10/2007 | Spielberger | |
| 7,377,066 | B2 | 5/2008 | Moore | |
| 7,458,179 | B2 | 12/2008 | Swan | |
| D590,473 | S | 4/2009 | Fitzpatrick et al. | |
| 7,520,083 | B2 | 4/2009 | Dextraze | |
| 7,523,580 | B1 | 4/2009 | Tankersley | |
| D593,633 | S | 6/2009 | Fitzpatrick et al. | |
| D593,634 | S | 6/2009 | Fitzpatrick et al. | |
| D593,635 | S | 6/2009 | Fitzpatrick et al. | |
| D594,083 | S | 6/2009 | Mayberry et al. | |
| D594,084 | S | 6/2009 | Mayberry et al. | |
| 7,552,557 | B1 | 6/2009 | Mabry | |
| D598,971 | S | 8/2009 | Peterson et al. | |
| 7,574,823 | B2 | 8/2009 | Nakayama | |
| D600,303 | S | 9/2009 | Fitzpatrick et al. | |
| D600,304 | S | 9/2009 | Fitzpatrick et al. | |
| D600,305 | S | 9/2009 | Fitzpatrick et al. | |
| D600,306 | S | 9/2009 | Fitzpatrick et al. | |
| D600,307 | S | 9/2009 | Fitzpatrick et al. | |
| D600,308 | S | 9/2009 | Fitzpatrick et al. | |
| D600,309 | S | 9/2009 | Fitzpatrick et al. | |
| D600,310 | S | 9/2009 | Fitzpatrick et al. | |
| D600,771 | S | 9/2009 | Fitzpatrick et al. | |
| 7,584,567 | B1 | 9/2009 | DeSomma et al. | |
| 7,673,412 | B2 | 3/2010 | Griffin | |
| D613,361 | S | 4/2010 | Peterson et al. | |
| D613,812 | S | 4/2010 | Peterson et al. | |
| 7,698,848 | B1 | 4/2010 | Bentley | |
| 7,775,150 | B2 | 8/2010 | Hochstrate et al. | |
| D623,718 | S | 9/2010 | Peterson et al. | |
| 7,802,392 | B2 | 9/2010 | Peterson et al. | |
| 7,827,721 | B2 | 11/2010 | Griffin | |
| 7,845,105 | B1 | 12/2010 | Cahill | |
| 7,870,689 | B2 | 1/2011 | Dextraze | |
| 7,930,849 | B2 | 4/2011 | Abraham et al. | |
| 7,975,417 | B2 * | 7/2011 | Duplessis et al. | 42/16 |
| 7,987,623 | B1 | 8/2011 | Moody et al. | |
| 8,028,440 | B2 | 10/2011 | Sokolowski et al. | |
| 8,028,459 | B2 | 10/2011 | Williams | |
| 8,028,460 | B2 | 10/2011 | Williams | |
| 8,051,594 | B2 | 11/2011 | Carr et al. | |
| 8,429,844 | B2 | 4/2013 | Dextraze et al. | |
| 2004/0000083 | A1 | 1/2004 | Grant, Jr. | |
| 2005/0262752 | A1 | 12/2005 | Robinson et al. | |
| 2006/0026883 | A1 | 2/2006 | Hochstrate et al. | |
| 2006/0162217 | A1 | 7/2006 | Longueira | |
| 2006/0236582 | A1 | 10/2006 | Lewis et al. | |
| 2006/0242880 | A1 | 11/2006 | Griffin | |
| 2007/0199225 | A1 | 8/2007 | Haugen | |
| 2007/0236790 | A1 | 10/2007 | Turienzo et al. | |
| 2008/0000134 | A1 | 1/2008 | Peterson | |
| 2008/0028662 | A1 | 2/2008 | Abraham et al. | |
| 2008/0092423 | A1 | 4/2008 | Keng | |
| 2008/0168695 | A1 | 7/2008 | Nakayama | |
| 2008/0236016 | A1 | 10/2008 | Fitzpatrick et al. | |
| 2008/0236017 | A1 | 10/2008 | Fitzpatrick et al. | |
| 2009/0038198 | A1 | 2/2009 | Yu | |
| 2009/0101776 | A1 | 4/2009 | Peterson et al. | |
| 2009/0107022 | A1 | 4/2009 | Fitzpatrick et al. | |
| 2009/0241397 | A1 | 10/2009 | Fitzpatrick et al. | |
| 2009/0277066 | A1 | 11/2009 | Burt et al. | |
| 2009/0288324 | A1 | 11/2009 | Peterson et al. | |
| 2010/0037505 | A1 | 2/2010 | Romer | |
| 2010/0180485 | A1 | 7/2010 | Cabahug et al. | |
| 2010/0192446 | A1 | 8/2010 | Darian | |
| 2010/0212206 | A1 | 8/2010 | Griffin | |
| 2010/0287809 | A1 | 11/2010 | Williams | |
| 2011/0061284 | A1 | 3/2011 | Cabahug et al. | |
| 2011/0099876 | A1 | 5/2011 | Bentley | |
| 2011/0214328 | A1 | 9/2011 | Williams | |

FOREIGN PATENT DOCUMENTS

| | | |
|---|---|---|
| DE | 1 225 517 | 9/1996 |
| DE | 102007034669 | 1/2009 |
| EP | 063 100 | 10/1982 |
| EP | 1206472 | 8/2000 |
| GB | 620 188 | 3/1948 |
| GB | 628 732 | 9/1949 |
| GB | 937941 | 4/1962 |
| WO | WO 90/10841 | 9/1990 |
| WO | WO 99/05467 | 2/1999 |
| WO | WO 2005/078374 A1 | 8/2005 |
| WO | WO 2008/105960 | 9/2008 |

(56) References Cited

FOREIGN PATENT DOCUMENTS

| | | |
|---|---|---|
| WO | WO 2009/061546 | 5/2009 |
| WO | WO 2010/141428 | 12/2010 |

OTHER PUBLICATIONS

A.M.S.D. Sniper Rifle, Apr. 21, 2006, pp. 1-6 through 6-6, Advanced Military System Design, Geneva, Switzerland.
A.M.S.D. Sniper Rifle, Jun. 18, 2004, pp. 1-6 through 6-6, Advanced Military System Design, Geneva, Switzerland.
Adelmann, S., An AE for Accuracy, Shooting Illustrated: Guns and Hunting, pp. 1/4 (Accuracy International 2009).
AE Users Manual, pp. 1-27, Accuracy International North America, Oak Ridge, TN.
Al Paulson, SRT Shadow Suppressor .338, Special Weapons 2007, pp. 60-63.
AW338 Sniper Rifle L96 gas STAR—WOLF armouries.co.uk.
AW50 Anti Material Sniper Rifle 0.50 Calibre & Telescopic Sight SuB 3–12×50 MKII 0.2 MRAD, pages cover—46, Issue 3, Accuracy International North America, Oak Ridge, TN 2003.
Bolt Action Rifles of the 20th Century, Rick Jamison, About.com Hunting/Shooting.
David Crane, LaRue Tactical Stealth OSR (Optimized Sniper Rifle) 7.62mm Sniper Carbine/Rifle, Rifles and Carbines, Nov. 23, 2008, http://www.defensereview.com/larue-tactical-stea.
Draft Performance Specification: Precision Sniper Rifle, Jun. 11, 2009, pp. 1-32, H92222-09-PSR.
FN Herstal—PGM 338 User Manual: 338 Lapua Magnum, Oct. 14, 2002, 16 pages, UME-PGM338-FNH.doc, FN Herstal.
FN Herstal—PGM 338 User Manual: 338 Lapua Magnum, Nov. 15, 2002, 16 pages, UME-PGM338.doc, PGM Precision, Poisy Cedex, France.
FN Herstal PGM Hecate II Manuel de IUtilisateur: 50 BMG—12.7 × 99mm, 18 pages, UMF-FN-HECATE-II.doc, FN Herstal Jan. 11, 2002.
Hanlon, M., The Best .338 Sniper Rifle in the World (Gomags RSS Feed—Nov. 26, 2008).
Hecate II User Manual, pages cover—28, Version 2.0, PGM Precision, Poisy Cedex, France.
Hecate II User Manual, pages cover—28, Version 2.2, PGM Precision, Poisy Cedex, France.
Hogg, I., The Worlds Sniping Rifles with Sighting Systems and Ammunition (Greenhill Books, London—Stackpole Books, PA 1998), 12 pages.
International Search Report and Written Opinion for PCT/US2010/036838 (Nov. 19, 2010) 27 pages.
Long Range Precision Rifles, Oct. 4, 2010, 1 page, FNH USA, Inc., http://web.archive.org/web/20031204162037/www.fnhusa.com/contents/r_pgm_6.htm.
Marstar Canada: IMI Galil Galatz Sniper rifle (Prohibited 12(5)) (Marstar Classic Collectibles) (2007), 3 pages.
Model Aw Sniper 7.62×51 Sniper Rifle Users Manual, pages cover—29, Accuracy International Limited, Hampshire, England.
OM 50 Owners manual, pp. 1-17, A.M.S.D., Geneva, Switzerland Dec. 31, 2004.
Operators Manual .50 Caliber Rifle M82A1, pages cover—33, Barrett Firearms Manufacturing, Inc., Murfreesboro, TN.
Operators Manual Long Range Sniper Rifle (LRSR), May 2004, pages cover, a-d, A/B, i-vi, 001 00-1—Index, CHQSoftware.com, Headquarters, Department of the Army.
PGM .338 LM User Manual, pages cover—24, Version 2.2, PGM Precision, Poisy Cedex, France.
PGM Hecate II Benützer-Handbuch: .50BMG—12.7 × 99mm, 18 pages, UMG-PGM-HECATE-II.doc, PGM Precision, Poisy Cedex, France Nov. 1, 2002.
PGM Hecate II Manuel de IUtilisateur: 50 BMG—12.7 × 99mm, 18 pages, UMF-PGM-HECATE-II.doc, PGM Precision, Poisy Cedex, France, Jan. 11, 2002.
PGM Precision catalogue, 2007, 20 pages, PGM Precision, Poisy Cedex, France.
Photograph: Nemisis Rifle, 3 pages.
Photographs: Shot Show Exhibit of Folding Stock Firearm (2008 Shot Show), 2 pages.
Prosecution file history for U.S. Appl. No. 12/541,806, filed Aug. 14, 2009.
Prosecution file history for U.S. Appl. No. 61/100,788, filed Sep. 29, 2008.
Sniper Rifles, 2 pages.
Technical Specification of APR308 Sniper System, Feb. 2, 2007, 24 pages, Brügger+Thomet, Switzerland.
Terry J. Gander, editor, Unmatched Design, Janes Infantry Weapons, 1997-98, pp. 146-147, 154-157, 186-187, 194-195, 212-213, Twenty-third Edition, Janes Information Group.
Ultima Ratio Cal. 7.62 × 51 NATO, 2005, 2 pages, PGM Precision, Poicy Cedex, France.
Ultima Ratio User Manual, pages cover—26, Version 2.0, PGM Precision, Poisy Cedex, France.
Ultima Ratio User Manual, pages cover—26, Version 2.2, PGM Precision, Poisy Cedex, France.
A New Level of Surgical Precision—Modular Sniper Rifle (MSR)—Remington Military Products Division www.remingtonmilitary.com: © The Freedom Group, 2009.

* cited by examiner

MODULAR FIREARM STOCK SYSTEM

CROSS REFERENCE TO RELATED APPLICATIONS

The present Patent Application is a continuation application of previously filed co-pending Divisional application Ser. No. 13/337,459, filed Dec. 27, 2011, which application is a divisional application of previously filed U.S. patent application Ser. No. 12/640,531, filed Dec. 17, 2009, which application claims benefit of U.S. Provisional Patent Application Ser. No. 61/184,630, filed Jun. 5, 2009 according to the statutes and rules governing provisional patent applications, particularly 35 U.S.C. §119(a)(i) and 37 C.F.R. §1.78(a)(4) and (a)(5). The specifications and drawings of each of said applications referenced above are specifically incorporated herein by reference as if set forth in their entireties.

FIELD OF THE INVENTION

The present disclosure relates to a modular firearm.

BACKGROUND OF THE INVENTION

Typically, most conventional firearms have been adapted for specific tasks and generally are limited to use with specific calibers and/or types of ammunition. However, demand is increasing for firearms that can be modified to fire different types of ammunition, and/or can be reconfigured for different environments and uses. For example, in military applications today, the environments in which soldiers are forced to fight are changing such that they can be in open desert and then move into close quarter's battle in a more urban area within the matter of a few hours. At the same time, their weapons needs can further change, i.e., they might be faced with need for a longer range, sniping weapon or alternatively with needs for a more standard infantry rifle depending on the environment or situation. Carrying multiple different firearms is, however, impractical as adding undue weight and bulk to soldiers' packs and gear. Additionally, for more specialized uses, such as for sniping and other tactical situations, the weapon must be configurable as needed to fit the shooter's particular needs and/or use in a particular combat situation.

It therefore can be seen that a need exists for a modular firearm that addresses the foregoing and other related and unrelated problems in the art.

BRIEF SUMMARY OF THE INVENTION

The present disclosure generally is related to a modular firearm that is easily reconfigurable based on operational needs. More specifically, the disclosure relates to a modular firearm that is configurable to enable operation using ammunition of different or varying calibers via interchangeability of minimal parts, accommodates a variety of different accessories, is easily convertible from an operating condition to a compact and secure transport configuration, and can be configured with various accessories and stock arrangements as needed to meet a specific combat or tactical situation and/or the preferences of the user/shooter.

According to another embodiment, the modular firearm can comprise a folding butt stock assembly that is moveable between an extended position for placing the firearm in an operating configuration and a folded position for placing the firearm in a transport configuration. The butt stock assembly includes a latch mechanism including a latch arm operable to remove a detent element from engagement with a chassis of the firearm, thereby enabling the stock to be unlocked from the extended position and pivoted into its folded position. In the folded position, the latch arm lockingly engages the chassis of the firearm, thereby securing the butt stock in the folded position. According to a further embodiment, the butt stock assembly can include a bolt handle opening configured to receive and retain a portion of the bolt assembly, such as, a projection, tab, or a bolt handle of the bolt assembly of the firearm when the butt stock is in the folded position, thereby helping to secure the bolt during transport of the firearm.

According to a further embodiment, the modular firearm can additionally comprise a modular hand guard assembly for mounting accessories on the firearm. The hand guard assembly includes a hand guard having a plurality of rail mounting platforms, with each platform being disposed in a separate plane, including a top rail for mounting accessories on a top platform of the hand guard, and which attaches the hand guard assembly to a top portion of the receiver, and one or more rail sections attached about different planes of the hand guard and firearm for mounting accessories on the firearm. A bottom portion of the hand guard assembly can also be attached to a chassis of the firearm, with the hand guard assembly generally being free from direct attachment to a barrel of the firearm. One or more recoil-absorbing mounting lugs further may be integrated in each rail or rail section.

According to still another embodiment, the modular firearm can include an integrated wire management system including one or more wire channels formed in an exterior surface of a chassis of the firearm and/or in an exterior surface of a hand guard of the firearm for accommodating cabling for one or more firearm accessories. Clips may be inserted in the channel(s) to secure the cabling and/or accessories at various locations along the channel(s).

According to yet another embodiment, the modular firearm further may include an actuator for a bolt stop/guide mechanism. The actuator may be centrally located on an upper rear surface of the receiver to enable ease of actuation or engagement by right and left-handed users.

Those skilled in the art will appreciate the above features and advantages, as well as additional features and advantages upon reading the following detailed description with reference to the accompanying drawings and appendix.

DETAILED DESCRIPTION OF THE INVENTION

FIGS. 1-16 show various features and components of a modular firearm F according to at least one example embodiment of the invention. In particular, the modular firearm F is shown as a bolt-action rifle, and more specifically, a bolt-action sniper rifle. However, it will be understood by those skilled in the art that the various aspects of the invention as described herein are suitable for other types of firearms, including various types of semi-automatic and fully automatic firearms such as handguns, rifles, shotguns, and other long-barreled firearms.

Figure 1:
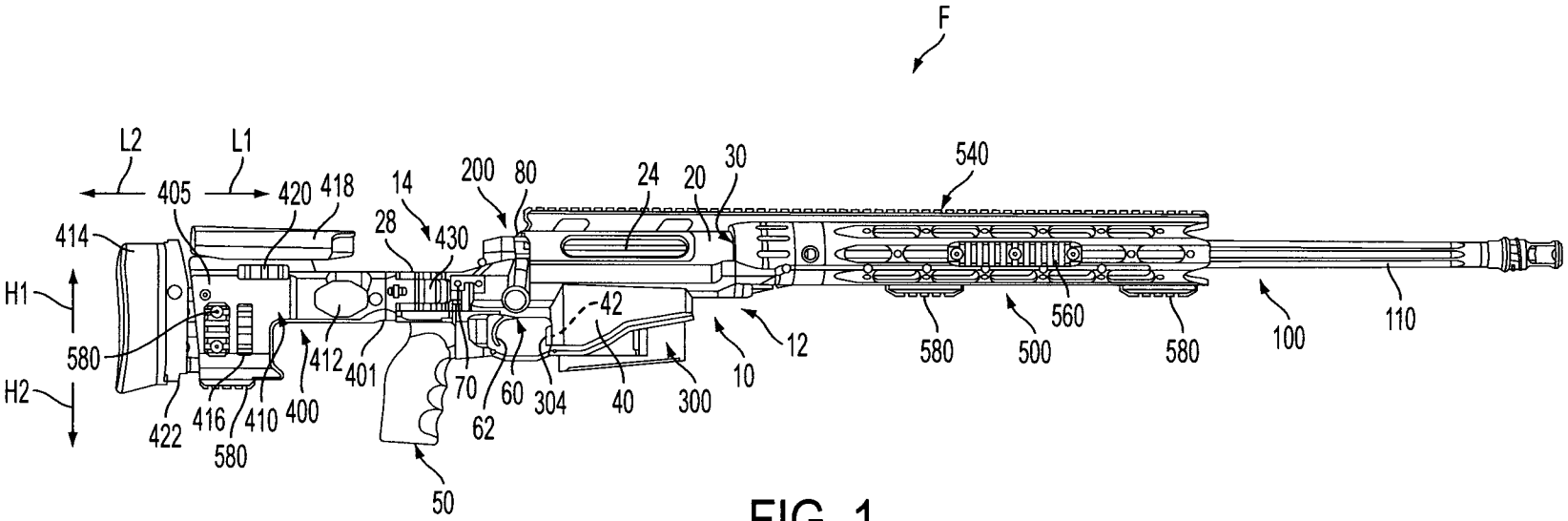
FIG. 1 is a side view showing one embodiment of a modular firearm, according to one example embodiment.

As shown in FIG. 1, the modular firearm F generally includes a frame or chassis 10 including a receiver 20, an interchangeable barrel assembly 100 mounted to the receiver 20 at a front end 12 of the chassis 10 and defining a chamber 30 at a position where the barrel 4 assembly 100 connects to the receiver 20, a magazine well 40 defined in the chassis 10 and in communication with the chamber 30, and a foldable butt stock assembly 400 mounted to a rear end 14 of the chassis 10. A pistol-style handgrip 50 can be connected to the chassis 10 adjacent the rear end 14 of the chassis 10, and a modular hand guard assembly 500 can be located along the front portion of the chassis 10 to assist in gripping and holding the firearm F. An interchangeable bolt assembly 200 generally is slidably received in the receiver 20 for operation of the firearm F. A fire control 60 is mounted to the chassis 10 for controlling firing of the firearm F. Additionally, ammunition magazine 300 will be received in the magazine well 40 for supplying ammunition to the receiver 20.

Figure 2:
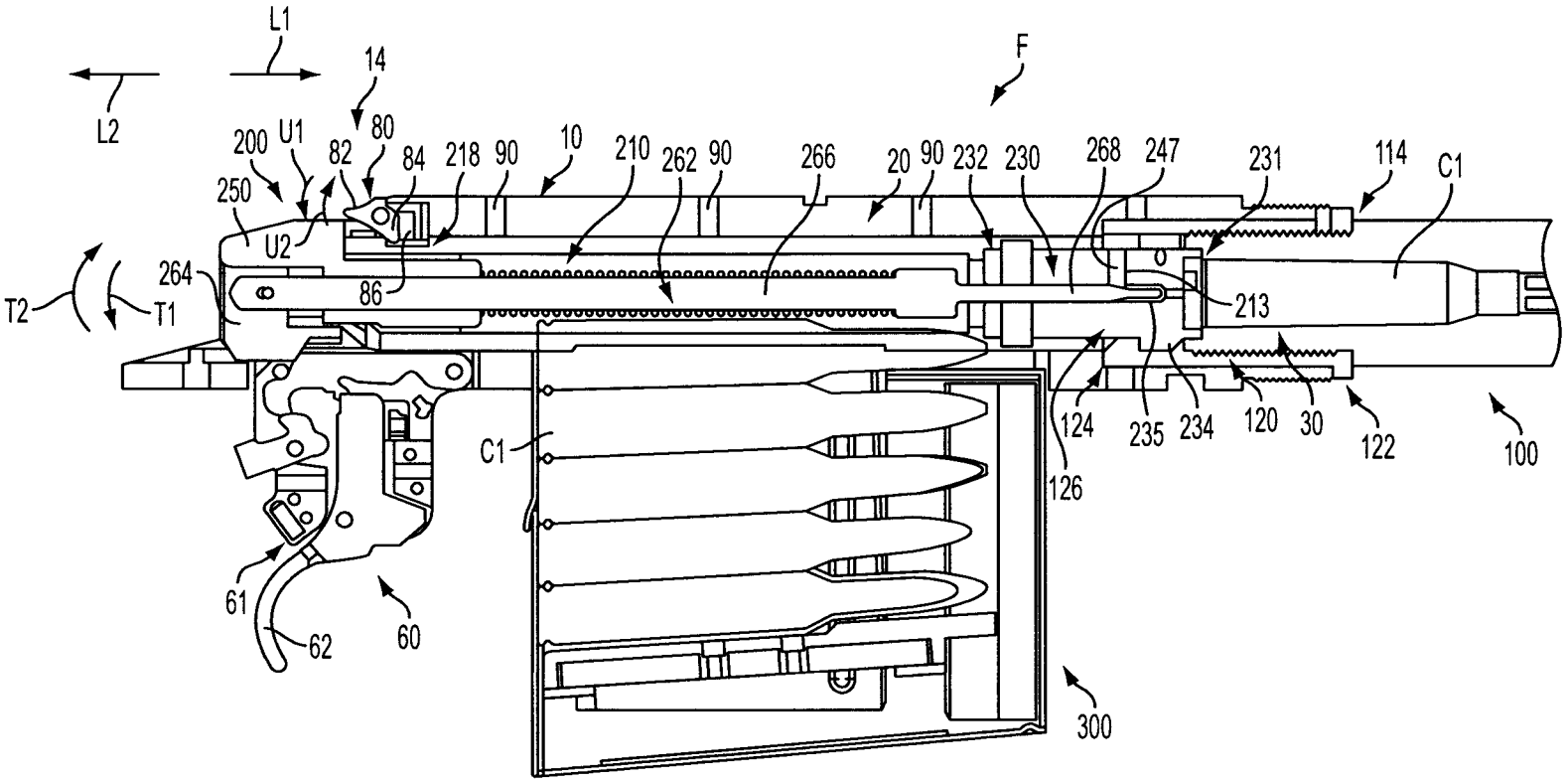
FIG. 2 is a partial cross-sectional view of the firearm.

Still referring to FIG. 1, the receiver 20 generally will be constructed of a high strength, durable, but lightweight material, typically a metal or metal alloy such as a titanium alloy. Referring to FIG. 2, a barrel engagement portion 22 of the receiver 20 can be constructed of the same material as the remainder of the receiver 20, or the barrel engagement portion 22 can be constructed of a different, durable, high strength material. For example, the barrel engagement portion 22 can be constructed of steel, thereby providing a steel-on-steel lockup arrangement between the barrel engagement portion of the receiver and the barrel extension 120 (FIGS. 2 and 3) when the barrel extension 120 is also constructed of steel. As shown in FIGS. 1 and 2, the receiver 20 includes a breech 24 through which casings from spent ammunition cartridges may be ejected from the firearm F.

Referring to FIGS. 1 and 2, the fire control 60 is provided for actuating/firing the firearm F and includes a trigger 62 as part of a trigger assembly housed in the chassis 10. The fire control 60 is operably connected to the firing pin 260 such that actuation of the trigger 62 operates a firing pin 262 (FIG. 2) to fire the firearm F. The fire control 60 can include an adjustable fire control system such as a Remington Arms Company, Inc. X Mark Pro fire control system, which generally is adjustable to enable variable pressure/trigger pulls, for example, from about 2.4 to about 4.5 pounds of pressure for actuation of the trigger assembly, although more or even less pressure also can be used as understood in the art.

Figure 3:
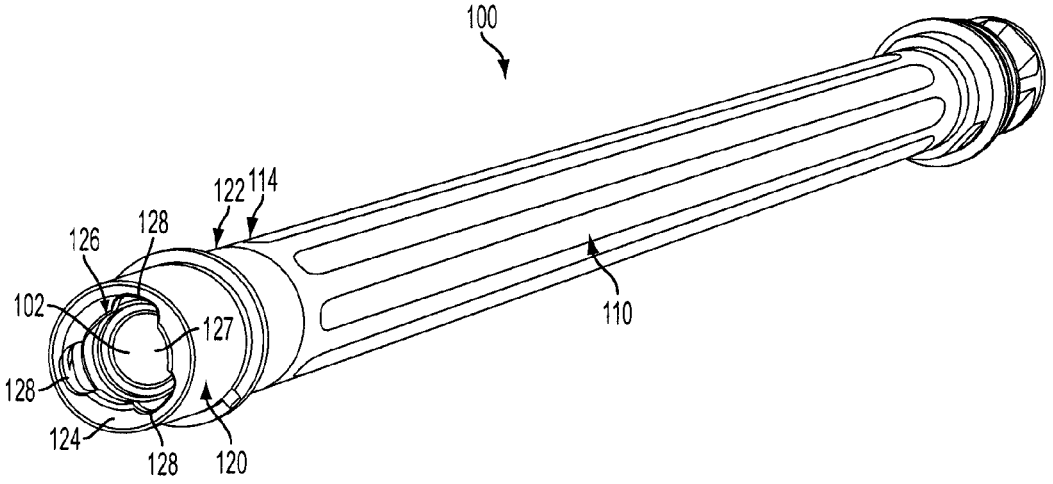
FIG. 3 is a perspective view of a barrel assembly of the firearm.

As shown in FIG. 3, the barrel assembly 100 includes a barrel 110 and a barrel extension 120 for mounting the barrel 110 to the receiver 20. The barrel 110 and barrel extension 120 define a central axial bore 102 and can be integrally formed so as to define a substantially unitary, single piece barrel assembly, or can be separately formed and adapted to connect together as a multi-piece barrel assembly. The forward or distal end 122 of the barrel extension 120 can be attached to a rear end 114 of the barrel by a threaded connection or adhesive bond, for example. A rear end 124 of the barrel extension 120 can be attached to the barrel engagement portion 22 of the receiver 20 at the front end 12 of the chassis 10 in a known manner. A locking aperture 126 for interfacing with the bolt assembly 200 is formed at the rear end 124 of the barrel extension 120 in alignment with the central axial bore 102. The locking aperture 126 includes a central aperture or bore 127 that communicates with the bore 102 of the barrel, and a plurality of recess portions 128 projecting radially outwardly from and spaced about the central aperture or bore 127 of the barrel.

Figure 4:
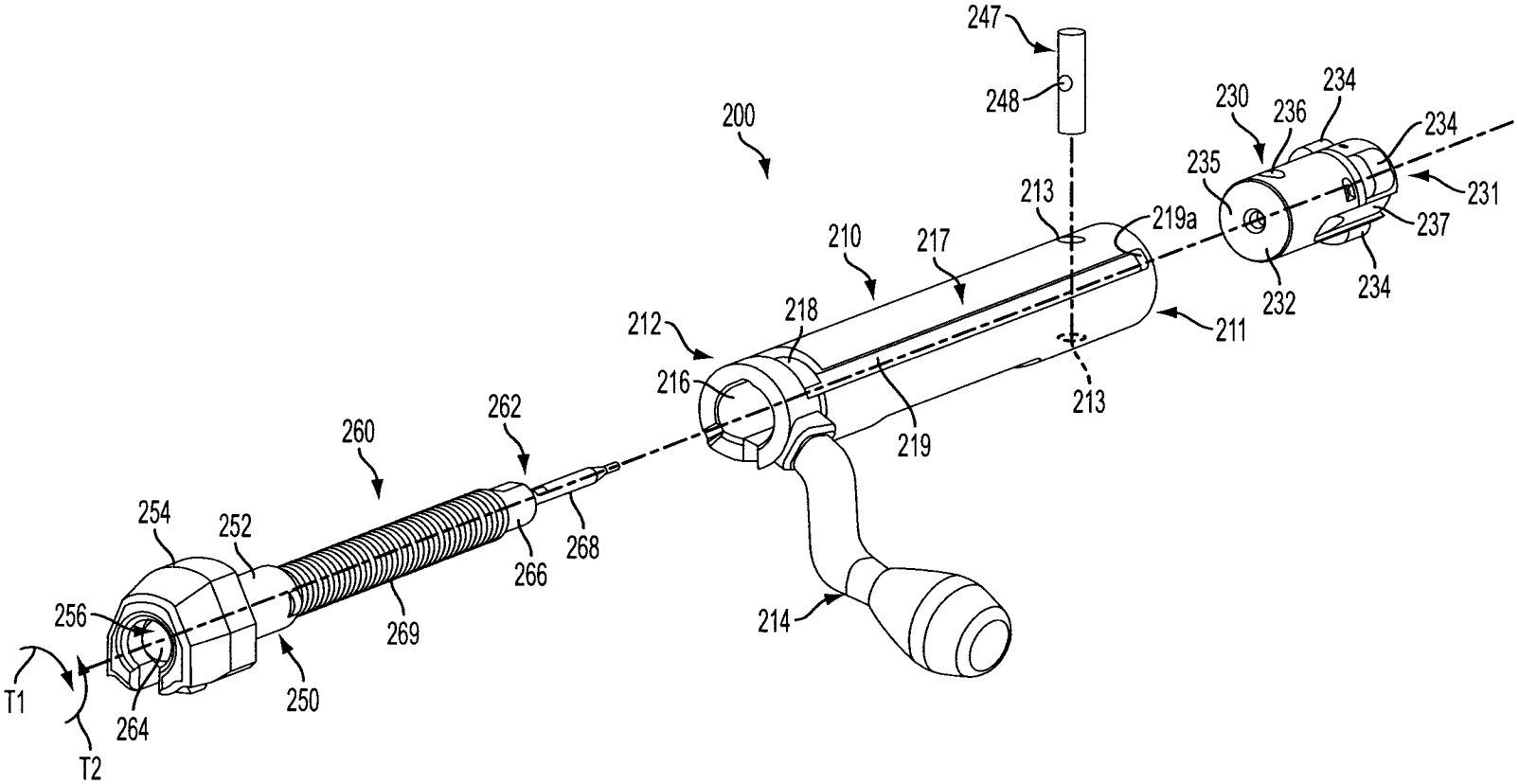
FIG. 4 is an exploded view of a bolt assembly of the firearm.
Figure 5:
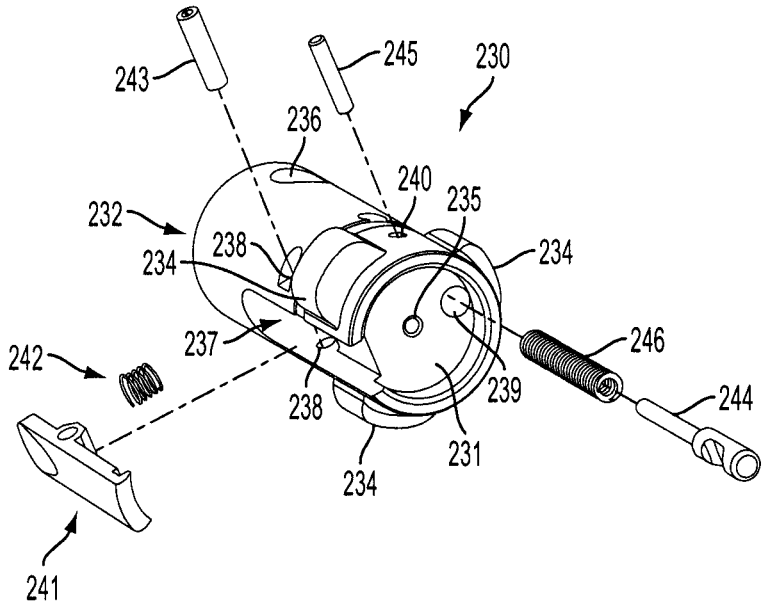
FIG. 5 shows an interchangeable bolt head of the bolt assembly, according to an embodiment, for use with the modular firearm of the present invention.

Referring to FIGS. 2, 4 and 5, the bolt assembly 200 of the firearm F generally includes a substantially hollow bolt body 210, an interchangeable bolt head 230 that can be configured to fit ammunition cartridges of a specific caliber, a bolt plug 250, and a firing pin assembly 160. The bolt body 210 typically includes a bolt handle 214 that can be grasped for sliding the bolt body 210 within the receiver 20, an axial bore 216 longitudinally extending from a rear or distal end 212 to a front or proximal end 211, and a transverse locking bore 213 located adjacent the front end 212 of the bolt body as indicated in FIG. 4. The bolt body 210 further generally includes a bolt guide channel 217 formed in an exterior surface of the bolt body 210. The bolt guide channel 217 includes a transversely extending channel segment 218 located near the rear end 212 of the bolt body 210, and an axially extending channel segment 219 extending from the transversely extending segment 218 towards the front end 211 of the bolt body 210. The bolt guide channel is adapted to be engaged by a guide member or rail within the receiver for guiding the bolt assembly during a loading and cocking operation of the firearm.

As illustrated in FIGS. 4 and 5, the bolt head 230 includes a front or proximal end 231 configured to engage an ammunition cartridge as shown in FIG. 2, a rear or distal end 232 configured to be received in and attached to the bolt body 210, and radially projecting locking lugs 234 (FIG. 5) located along the side wall of the bolt body adjacent the front end 231. The locking lugs 234 are configured to selectively engage the locking aperture 126 (FIG. 2) of the barrel extension 120 for securing the bolt head 230 in place during firing of the firearm F, as will be described later. As shown in FIGS. 4-5, the bolt head 230 further includes an axially extending firing pin bore 235 that aligns with the tip portion 268 of the firing pin 262 of the firearm, a transverse bolt head locking bore 236, an axially extending extractor mounting channel 237, aligned transverse pivot pin bores 238 intersecting the extractor mounting channel 237, an axially extending ejector mounting bore 239, and a transverse ejector locking channel 240.

Referring again to FIG. 4, the bolt head 230 is releasably mountable to the front end 211 of the bolt body 210 by engagement of a locking pin 247 that is insertable in the transverse bolt head locking bores 213, 236 to enable removal and/or change-out of the bolt face as needed to change the caliber of the firearm and enable firing of different types/calibers of ammunition. The locking pin 247 further can be configured so as to include an axial bore 248 for receiving a tip portion 268 of a firing pin 262 therethrough so as to enable the bolt face change-out without interfering with or requiring change-out of the firing pin as well.

Referring to FIG. 5, one or more extractors 241 can be pivotally mounted in one or more extractor mounting channels 237 (only one shown) by engagement with a pivot pin 243 inserted through the transverse pivot pin bores 238. A biasing spring 242 can be inserted in the extractor mounting channel 237 between the bolt head 230 and the extractor 241 to pivotally bias the extractor 241 toward an engaging position for engaging and holding the ammunition cartridge for extraction upon operation of the bolt assembly after firing. As further indicated in FIG. 5, an ejector 244 can be mounted in the ejector mounting bore 239 with a locking pin 245 inserted through an ejector locking channel 240 for releasably securing the ejector. An ejector spring 246 generally coaxially positioned with the ejector 244 along the ejector mounting bore 239, so as to bias the ejector forwardly and control axial movement during extraction and ejection of the spent cartridge by the ejector 244 of the bolt head.

As illustrated in FIG. 4, the bolt plug 250 is generally hollow so as to define an axial bore 256 therethrough, and includes a front portion 252 insertable in the rear end 212 of the bolt body 210, a rear portion 254, and an axial bore 256 extending from the front portion 252 to the rear portion 254 for receiving the firing pin assembly 260. The rear portion 254 of the bolt plug 250 is configured to abut the rear end 212 of the bolt body 210 and thereby limit the depth of insertion of the front portion 252 in the bolt body 210.

Sill referring to FIG. 4, the firing pin assembly 260 includes the firing pin 262, which includes a head portion 264 mountable within the axial bore 256 of the bolt plug 250, a body portion 266 insertable in the axial bore and mountable to the head portion 264, and a tip portion 268, which projects forwardly from the body portion 264 so as to extend through the bore 235 of the bolt head assembly for engaging and firing a round of ammunition or cartridge within the chamber of the firearm. The firing pin assembly 260 further generally includes a recoil spring 269 mountable around the body portion 266.

When the bolt assembly 200 is assembled as shown in FIG. 2, the bolt head 230 is connected to the front end 211 of the bolt body 210, the firing pin assembly 260 is connected to the bolt plug 250, and the bolt plug 250 and firing pin assembly 260 are inserted into the bolt body 210. Specifically, the rear end 212 of the bolt head 210 is inserted into the axial hole 216 in the bolt body 210 through the front end 211 of the bolt body 102, and the transverse locking bore 236 in the bolt head 230 is aligned with the transverse locking bores 213 in the bolt body 210, and the locking pin 247 is inserted through the locking bores 213, 236, thereby securing the bolt head 230 to the bolt body 210. The firing pin assembly 260 is mounted to the bolt plug 250 such that the firing pin 262 is inserted through the axial bore 256 of the bolt plug 250, the head portion 264 of the firing pin is attached to the bolt plug 250, the body and tip portions 266, 268 of the firing pin extend from the front portion 252 of the bolt plug 250, and the recoil spring 269 is positioned around the body portion 266 of the firing pin. The body and tip portions 266, 268 of the firing pin 262 and the front portion 252 of the bolt plug 250 are inserted into the bolt body 210 such that the tip portion 268 of the firing pin 262 is aligned with and can be actuated to extend through the axial firing pin bore 235 and the axial bore 248 in the locking pin 247. The rear portion 254 of the bolt plug 250 further typically is secured to the rear end 212 of the bolt body 210 to complete the bolt assembly 200.

According to one example embodiment, the length of the bolt assembly 200 can allow feeding and ejection of various length ammunition cartridges up to 4.2" long, although various other larger or smaller size and/or caliber cartridges also can be used. If it is desired to change the caliber of ammunition used with the firearm F, the bolt assembly 200 can easily be removed from the firearm F, and the bolt head 230 can be disconnected from the bolt assembly 200 by removing the locking pin 247 from the transverse locking bores 213 and 236. With the locking pin removed, the bolt head 230 can be disengaged from the bolt body 102. The bolt head 230 can then be replaced in the bolt assembly 200 with a replacement bolt head of the desired ammunition caliber, and the bolt assembly including the replacement bolt head can be reinstalled in the firearm F. Additionally, the barrel 110 (FIG. 3), which defines a chamber of a first ammunition caliber, also generally will be disengaged from the receiver of the firearm and a new, second barrel defining a chamber configured to receive ammunition cartridges of a second, different caliber or size can be installed in its place to facilitate firing of a new, different caliber or type of ammunition. Together with various size ammunition magazines, or a reconfigurable magazine as noted below, the interchangeable barrel and bolt assembly can define a simple and different caliber conversion system or assembly for the firearm.

Figure 6:
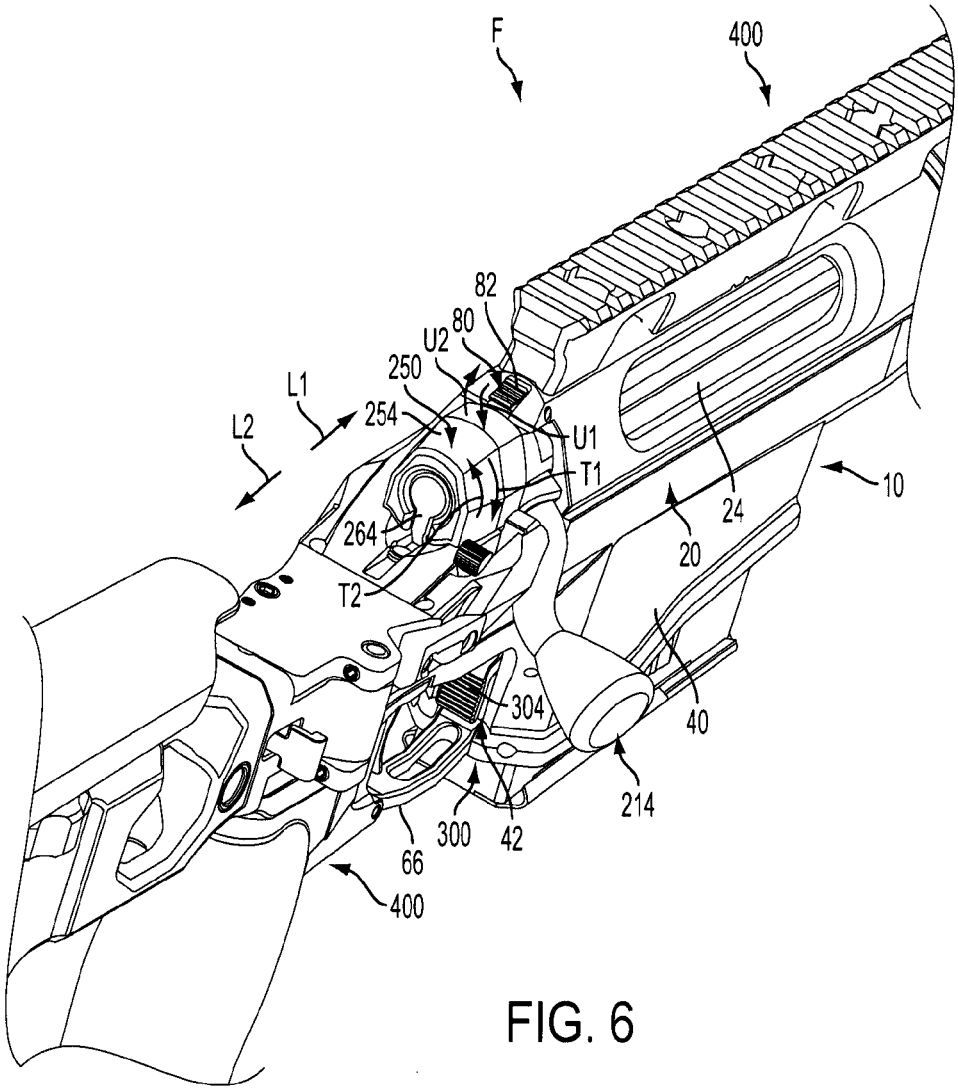
FIG. 6 is a perspective view of the firearm illustrating operation of the bolt assembly of FIG. 5.

As shown in FIGS. 2 and 6, when the firearm F is in a normal operational condition for firing a round of ammunition, the bolt assembly 200 is slidably mounted in the receiver 20 for chambering and ejecting ammunition. A bolt stop lever 80 is pivotally mounted to the receiver 20. The bolt stop lever 80 is located at a central, upper, rear region of the receiver 20, and includes an external grip portion 82 and a guide arm 84 extending from the grip portion 82. The grip portion 82 is exposed on the external surface of the firearm F at the central, upper, rear region of the receiver 20, and is operable by a user's finger or thumb at the exterior of the firearm F to pivot the bolt stop lever 80 in directions U1, U2. The guide arm 84 selectively registers with the guide channel 217 (FIG. 4) extending along the bolt body 210 based on the pivotal position of the bolt stop lever 80. The bolt stop lever 80 may be biased in the direction U2 by a biasing member, such as a spring 86, to protect against accidental disengagement of the bolt stop lever with the guide channel 217. As FIG. 2 indicates, the bolt stop lever cooperates with a transverse channel segment 218 of the channel 217 (FIG. 4) in the bolt body 210 to guide forward and rearward linear movement of the bolt assembly 200 in the directions L1, L2, guide rotation of the bolt assembly 200 about its central axis in the directions T1, T2 and selectively stop or limit travel of the bolt assembly 200 in the rearward direction L2. Thus, the channel 217 and the lever 80 together form a bolt stop and guide mechanism. As FIG. 2 indicates, the engagement of the lugs 234 with locking aperture 126 helps to limit rearward linear movement of the bolt assembly 200 in the direction L2, so as to assist in selectively stopping or limiting travel of the bolt assembly 200 in the rearward direction L2.

In operation of the bolt assembly 200 and the bolt stop lever, as shown in FIGS. 2 and 6, the bolt assembly 200 generally is disposed in a forwardmost, position in the receiver and rotated in the direction T1 about its central axis with the bolt handle 104 turned to and its downwardmost position, when in an operating condition. The bolt head 230 extends through the locking aperture 126 in the barrel extension 120 and is oriented such that the locking lugs 234 are out of alignment with the outer aperture portions 129 of the locking aperture 126, thereby locking the bolt head 230 in the barrel extension 120. The bolt stop lever 80 is in its downwardmost position in the direction U1 such that the guide arm 84 is in registry with the transverse channel segment 218 of the channel 217 in the bolt body 210. With the bolt assembly 200 and the bolt stop lever 80 in this configuration, the bolt assembly 200 is restricted from moving in the directions L1, L2 and the firearm F is configured for firing a round of ammunition C1 from the chamber 30.

In order to eject a round of ammunition C1 (FIG. 2) or a casing of a spent round of ammunition C1 from the magazine well 40 into the receiver 20, the bolt assembly 200 can be rotated in the upward in the direction U2 and moved rearward in the direction L2. Specifically, the bolt assembly 200 can be rotated in the upward in the direction U2 such that the guide arm 84 is in registry with the axial channel segment 219 and the bolt handle 214 is in its upwardmost position. With the bolt assembly 200 in this position, the locking lugs 234 of the bolt head 230 are aligned with the outer aperture portions 129 of the locking aperture 126. After rotating the bolt assembly 200 in the direction U2 as described, the bolt assembly 200 can be moved rearwardly in the direction L2 to its rearwardmost position such that the bolt head 230 passes out of the locking aperture 126.

During rearward movement of the bolt assembly 200, the extractor 241 (FIG. 5) will grab the casing/ammunition round C1 and the ejector 244 will eject the casing/ammunition round C1 from the breech 24 (FIG. 2). The bolt assembly 200 is restricted from rotating during its rearward movement. When the bolt assembly 200 is in its rearwardmost position, the guide arm 84 remains in registry with the channel segment 219, engaging a front edge of the channel segment 219 to prevent the bolt assembly 200 from being inadvertently removed from the receiver 200. If it is desired to remove the bolt assembly 300 from the receiver (to replace the bolt head 110, for example), the bolt stop 80 may be pivoted downward in the direction U1 to deregister the guide arm 84 and disengage the locking lugs from the locking aperture, thereby allowing the bolt assembly 200 to slide rearwardly out of the receiver 20.

As indicated in FIGS. 2 and 6, after ejecting a spent cartridge or round, the bolt assembly 200 may be moved forward in the direction LI from its rearwardmost position in order to advance a next or new ammunition cartridge C1 from the ammunition magazine 300 to the chamber. During such forward movement, the guide channel segment 119 engages the guide arm 84 such that the bolt assembly 200 cannot rotate in the directions T1, T2 until the bolt assembly reaches its forwardmost position in the receiver. The bolt assembly 200 then can be turned downwardly in the direction T1 to lock the bolt assembly 200 in position for firing the round of ammunition C1, as described above.

As perhaps best shown in FIG. 6, the location of the bolt stop lever 80 enables ambidextrous operation of the bolt stop lever 80. Additionally, with the bolt stop lever 80 positioned centrally on an upper rear surface of the receiver 20, the bolt stop lever 80 is naturally shielded by a top rail 540 (described in detail later) and potentially by a scope or other aiming optics (not shown) or accessories that may be mounted on the top rail 540. Inadvertent operation of the bolt stop/guide lever 80 can therefore be prevented without the requirement of additional fencing material or a cover.

Figure 7:
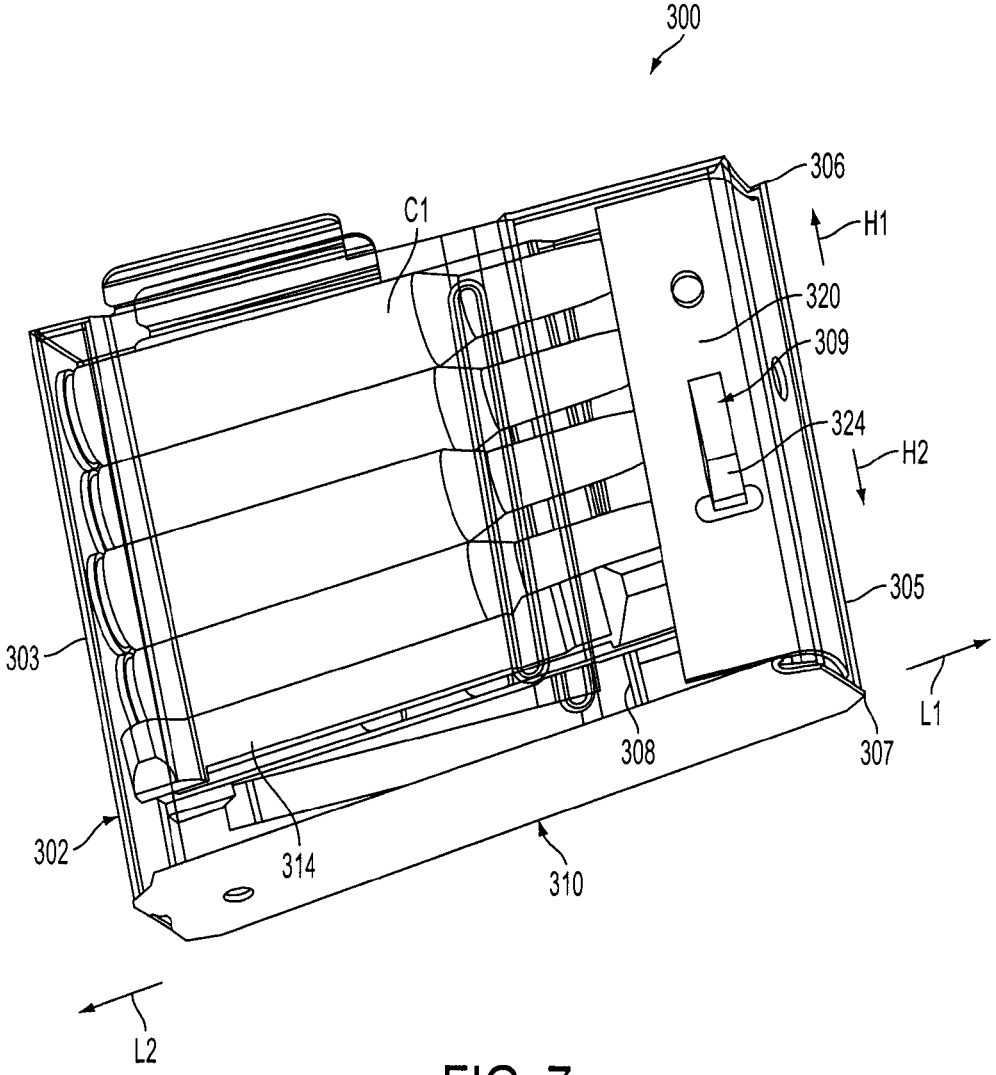
FIGS. 7-8 show an embodiment of a modular ammunition magazine for use with the modular firearm of the present invention.
Figure 8:
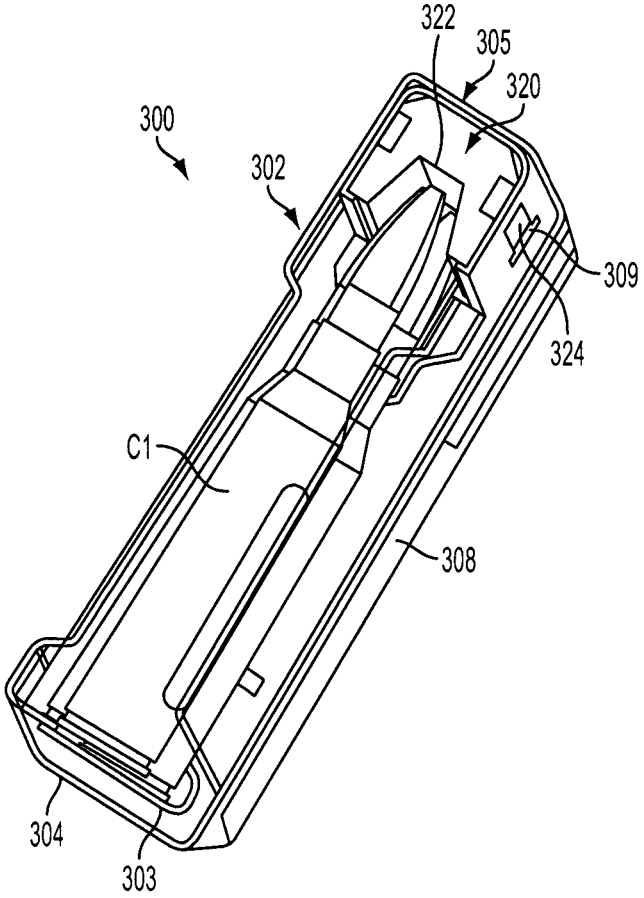

Referring to FIGS. 2, 7 and 8, a magazine 300 generally will be received within the magazine well 40. In one embodiment, the magazine 300 can be a modular, interchangeable magazine including a magazine box or magazine body 302, as shown in FIGS. 7-8 and having a removable bottom plate 307, and a magazine follower assembly 310 disposed in the magazine body 302 for advancing ammunition cartridges towards the top of the magazine body 302. As indicated in FIG. 7, the bottom plate 307 of such a magazine can be removed from the magazine body 302 to enable repair or replacement/reconfiguration of parts by sliding the bottom plate forward in the direction L1 off of the magazine body 302. Conversely, the bottom plate 307 can be reconnected to the magazine body 302 by sliding the bottom plate rearwardly in the direction L2 onto the magazine body 302.

As an example, the magazine 300 can be a center feed, double stack type magazine capable of feeding ammunition from 1-2 stacked, parallel rows or groups as indicated in FIGS. 2 and 7-8. A spring-loaded magazine release button 304 (FIGS. 6 and 9) can be provided on a rear wall 303 of the magazine body 302 for selectively locking the magazine 300 in the magazine well 40 and releasing the magazine 300 from the magazine well 40. Specifically, when the magazine 300 is inserted in the magazine well 40, the spring-loaded release button 304 is biased into engagement with a locking aperture 42, which is positioned in a rear wall of the magazine well 40, adjacent the receiver 20 and above a trigger guard 66 of the firearm F. The spring-loaded release button 304 can be depressed to disengage the locking aperture 42 and allow the magazine 300 to be removed from the magazine well 40.

In another embodiment, the magazine 300 can be adjustable so as to be reconfigurable to accommodate cartridges of different lengths, sizes, and/or different calibers of ammunition within a specific caliber by way of a removable/interchangeable spacer 320 that is insertable in the magazine body 302 at a front end 305 thereof. As illustrated in FIGS. 7 and 8, the magazine 300 generally can be configured to accommodate standard length ammunition cartridges C1 when the spacer 320 is installed in the magazine body 302. A cutout or channel 322 (FIG. 8) is provided in the spacer 320 and is configured to receive and retain front ends of the cartridges C1. The spacer 320 is configured to extend substantially from a top 306 to the bottom plate 307 of the magazine body 302. As perhaps best shown in FIG. 7, the spacer 320 can include resilient detent members 324 configured to lock the spacer 310 within the magazine body 302 by engaging locking channels 309 in side walls 308 of the magazine body 302. The spacer 320 can be connected to the magazine body 302 by removing the bottom plate 307 and inserting the spacer upwardly into the magazine body in the direction H1 until the detent members 324 lockingly engage the locking channels 309.

As indicated in FIGS. 2 and 8, the magazine 300 can be configured to accommodate longer, non-standard length ammunition cartridges C2 when the spacer 320 is removed from the magazine body 302. As FIG. 8 illustrates, the spacer 320 can be removed from the magazine body 302 by depressing the detent members 324 until the detent members 324 disengage the locking channels 307, and then moving the spacer 320 downward in the direction H2, out of the magazine body 302.

Figure 9:
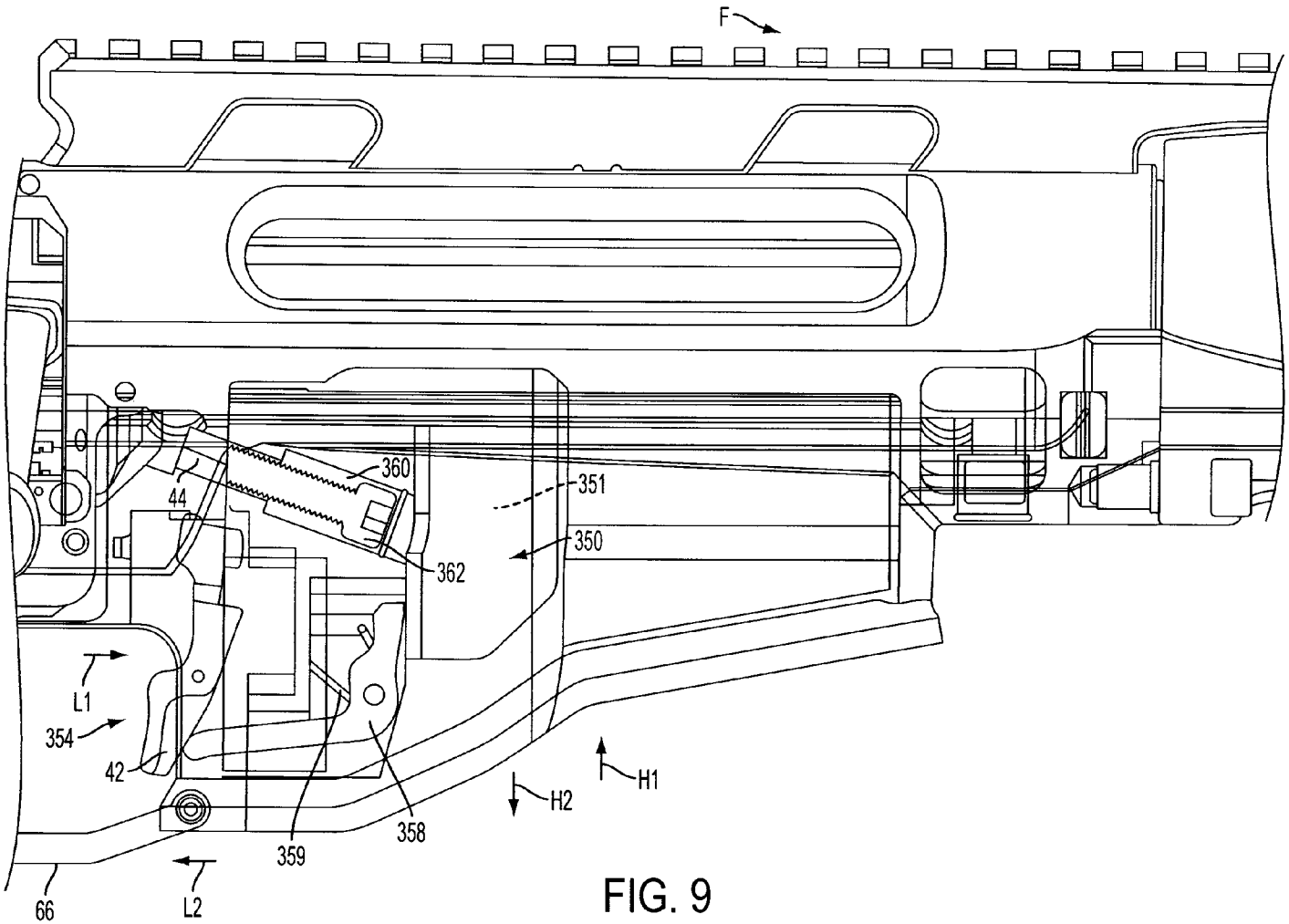
FIGS. 9 and 10 show an ammunition magazine conversion block, according to one example embodiment.
Figure 10:
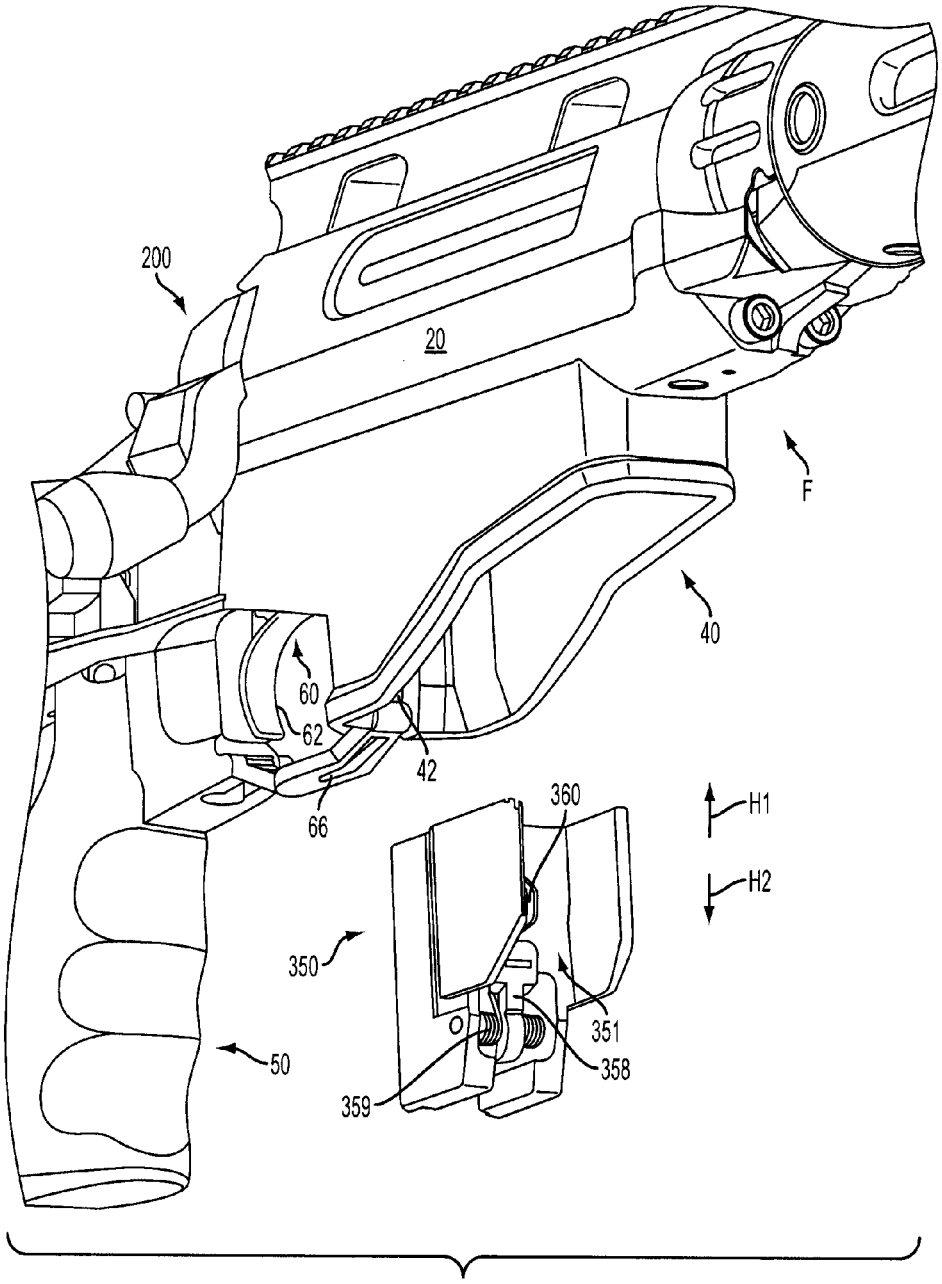

It is further envisioned that the spacer 320 can be interchanged with other spacers of different configurations to accommodate other ammunition cartridges of various lengths/sizes and/or calibers. Additionally, the magazine 300 may be interchanged with other magazines configured to accommodate ammunition cartridges of different calibers and/or lengths. For example, as shown in FIGS. 9-10, the receiver 20 can include a conversion block mounting bore 44 adjacent the magazine well 40 for mounting a magazine conversion block 350 in the magazine well 40. The magazine conversion block 350 can be, for example, a 7.62 mm NATO conversion block that enables smaller 7.62 mm NATO ammunition magazines to be inserted in the magazine well 40.

Referencing FIG. 10, the magazine conversion block 350 includes a cradle portion 351 for receiving an ammunition magazine (not shown) that is smaller than the magazine 300 described above. As illustrated in FIGS. 9 and 10, the magazine conversion block 350 includes catch assembly 354 including a release arm 356 that is biased rearward in the direction L2 by a pivotable biasing arm 358. The biasing arm 358 is biased rearward against the release arm 356 by a torsional spring 359. The magazine conversion block 350 also has a central mounting bore 360 configured for alignment with the conversion block mounting bore 44.

As can be understood from FIGS. 9 and 10, the magazine conversion block 350 can be installed in the magazine well 40 by sliding the conversion block 350 upward in the direction H1 until the release arm of the magazine release button 304 (FIG. 9) snaps into the locking aperture 42 above the trigger guard 66 and the central mounting bore 360 is aligned with the conversion block mounting bore 44. A fastener 362, such as a bolt or screw, can then be inserted into the bores 360, 44 to secure the magazine conversion block 350 in place. The magazine conversion block 350 can be uninstalled from the magazine well 40 by removing the fastener 362, pressing the release arm 356 forward in the direction L1 against the bias of the biasing arm 358 until the release arm 356 disengages the locking aperture 42, and then sliding the magazine conversion block 350 downward in the direction H2 out of the magazine well 40.

It can be understood from the above disclosure that, due to the reconfigurability of the barrel assembly 100 and the bolt assembly 200, the firearm F can be modified to operate with ammunition of multiple calibers by changing or reconfiguring only the barrel 100, bolt head 230, and the magazine 300 if needed. According to one example, the barrel assembly 100, bolt head 230 and magazine 300 may be packaged together as a caliber conversion assembly or kit configured for operation with ammunition of a specific caliber. Due to the modular designs of the barrel assembly 100, the bolt assembly 200 and the magazine 300, the barrel assembly 100, bolt head 230 and magazine 300 can easily and quickly be installed in and uninstalled from the firearm F to replace and be replaced by respective barrel assemblies, bolt heads and magazines as needed for accommodating operation of the firearm with ammunition of other, different calibers and/or sizes. For example, the firearm F can be convertible to operate with ammunition calibers including, but not limited to, 338 Lapua Magnum and 300 Winchester Magnum. Furthermore, with the use of the magazine conversion block 350, operation of the firearm F with 7.62 mm NATO ammunition is possible. It should be understood that, due to the modular design of the barrel assembly 100, bolt assembly 200, the firearm F also can be configured to be convertible to operate with ammunition calibers other than those specifically discussed.

Figure 11A:
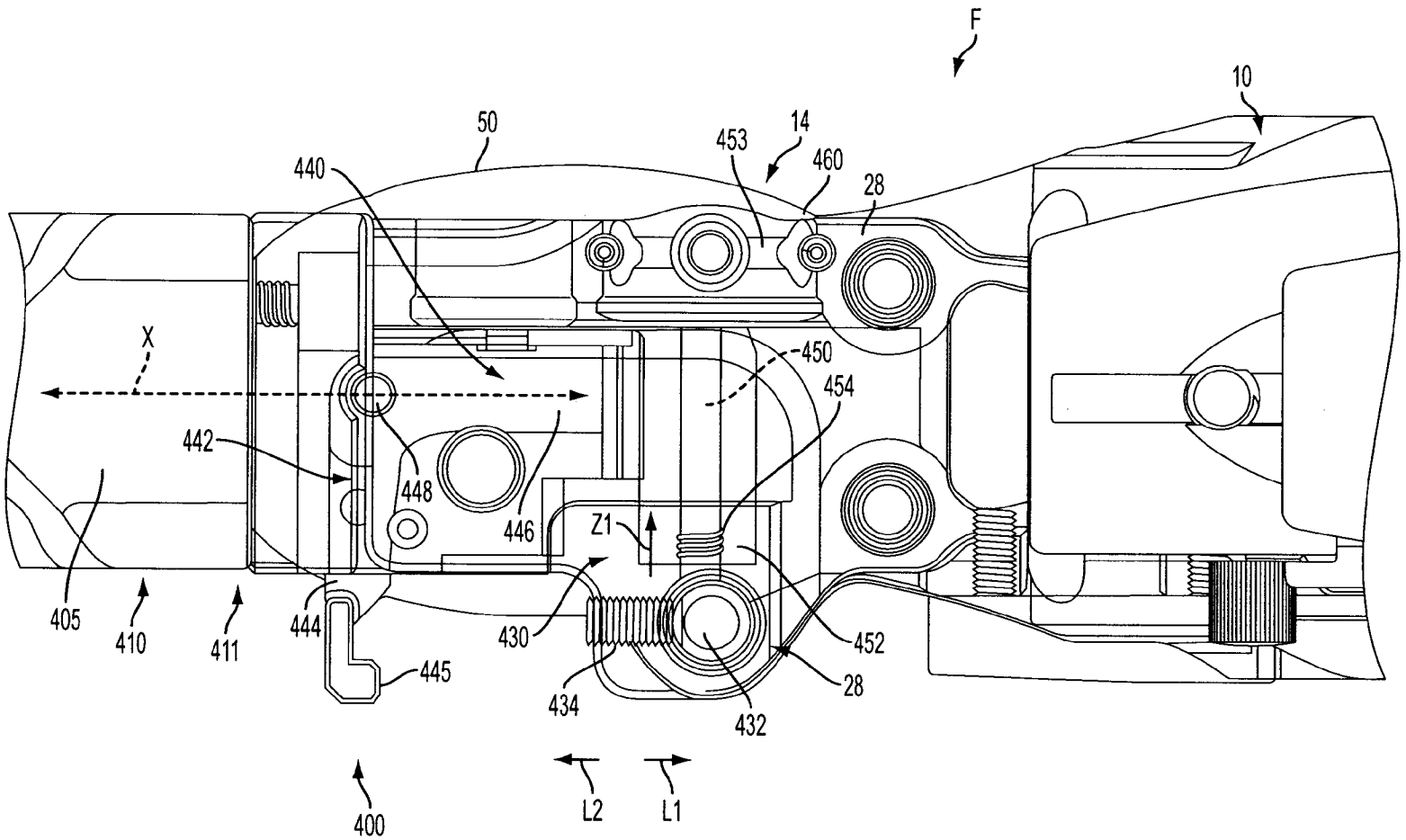
FIGS. 11A-11C are partially transparent views showing a butt stock assembly for the modular firearm, according to one example embodiment, and illustrate a process for folding the butt stock assembly from an extended position for operating the firearm to folded position for transporting the firearm.

FIGS. 1 and 11A show the firearm F in a shooting configuration with the foldable butt stock assembly 400 in an extended position, in line with the chassis 10. As illustrated in FIGS. 1 and 11A-11C, the butt stock assembly 400 includes a butt stock 410 having a body or frame 405, and a hinge member 430 connected to a front end 411 of the butt stock 410. The hinge member 430 is pivotally connected to hinge bracket 28 at the rear or distal end 14 of the chassis by a hinge pin 432. A threaded member such as a screw 434 can extend transversely to and bear against the hinge pin or bolt 432 within the hinge member 430 to reduce slack or spacing in the connection between the hinge member 430 and the hinge bracket 28, and further helps prevent the hinge pin 432 from separating from the chassis system. The axial position of the screw 434 in the directions L1-L2 can be adjusted to vary the degree to which the screw 434 bears against the hinge pin 432, and thereby adjust the amount of slack in the connection between the hinge member 430 and the hinge bracket 28. The butt stock 410 includes a bolt handle window or opening 412 for receiving the bolt handle 214 when the stock is in the folded (or retracted) configuration (FIGS. 11C-12).

An adjustable butt plate 414 further generally is connected to a rear end of the stock body or frame 405. The butt plate 414 can be vertically adjustable upwardly and downwardly in the directions H1 and H2 by an adjustment feature or member 422 adjacent a lower or bottom portion of the butt plate and pad 414. The length of pull of the butt plate is adjustable, as indicated by arrows L1-L2 in FIG. 1, by engagement/rotation of a first adjustment knob or wheel 416. An adjustable cheek piece or comb 418, typically formed from a resilient cushioning material, also can be connected to the stock body 405, extending upwardly from the butt stock 410, and is adjustable in a vertical direction with respect to the firearm F via a second adjustment knob or wheel 420. As a result, the comb or cheek piece 418 can be adjusted in the direction of arrows H1-H2 to fit a user's preference or comfort. The cheek piece further can be adjusted in the longitudinal direction (indicated by arrows L1-L2) by disengaging fasteners securing the check piece, adjusting it forwardly or rearwardly as desired, and thereafter resecuring the cheek piece with the fasteners. Additionally the length of pull of the butt stock assembly 400 can be adjustable via the addition and removal of spacers that are insertable between the butt stock body 405 and the butt plate 414. According to an exemplary embodiment, the length of pull may be adjustable between about 12.4 inches and about 14.4 inches.

Figure 11B:
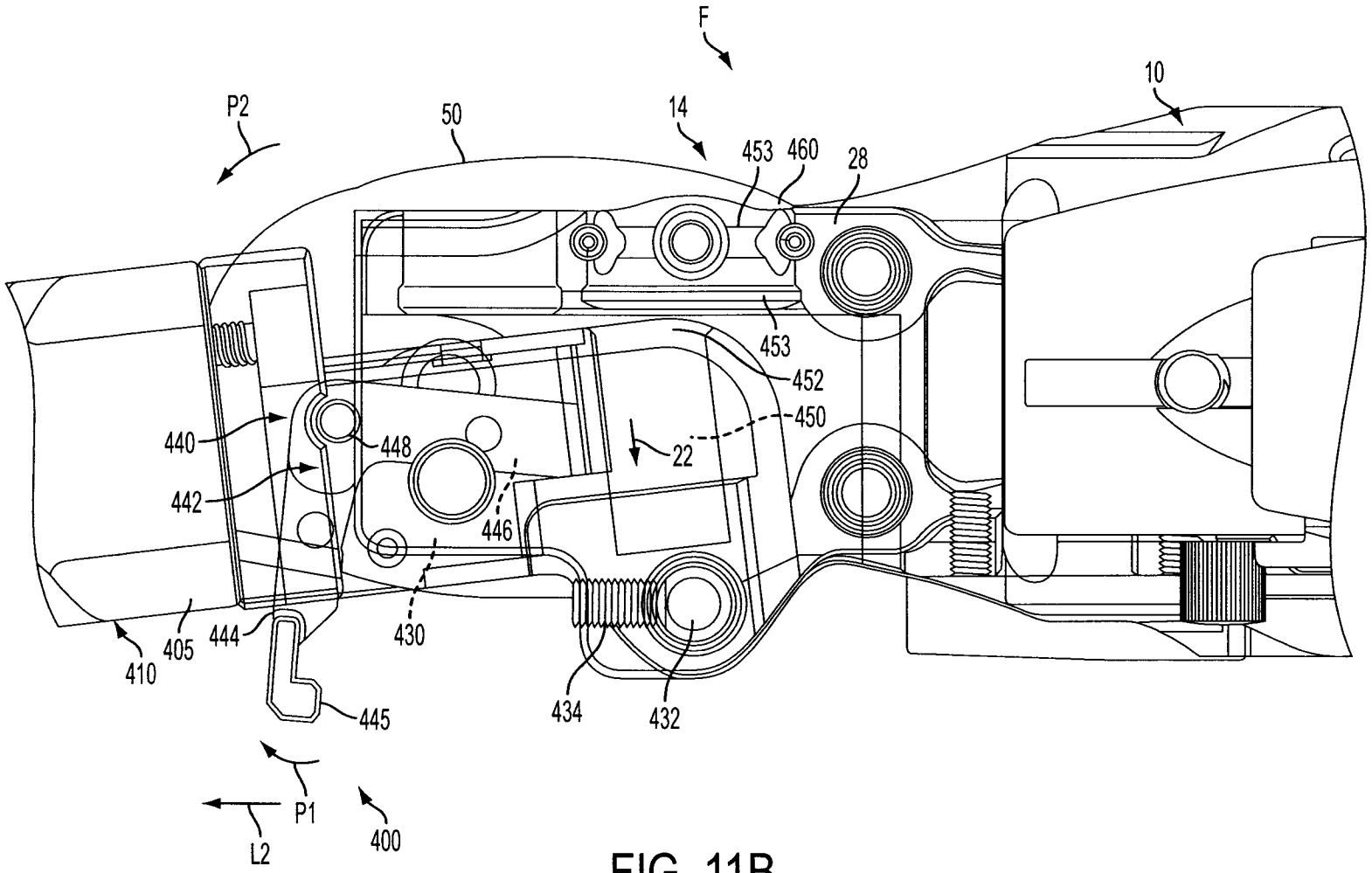
Figure 11C:
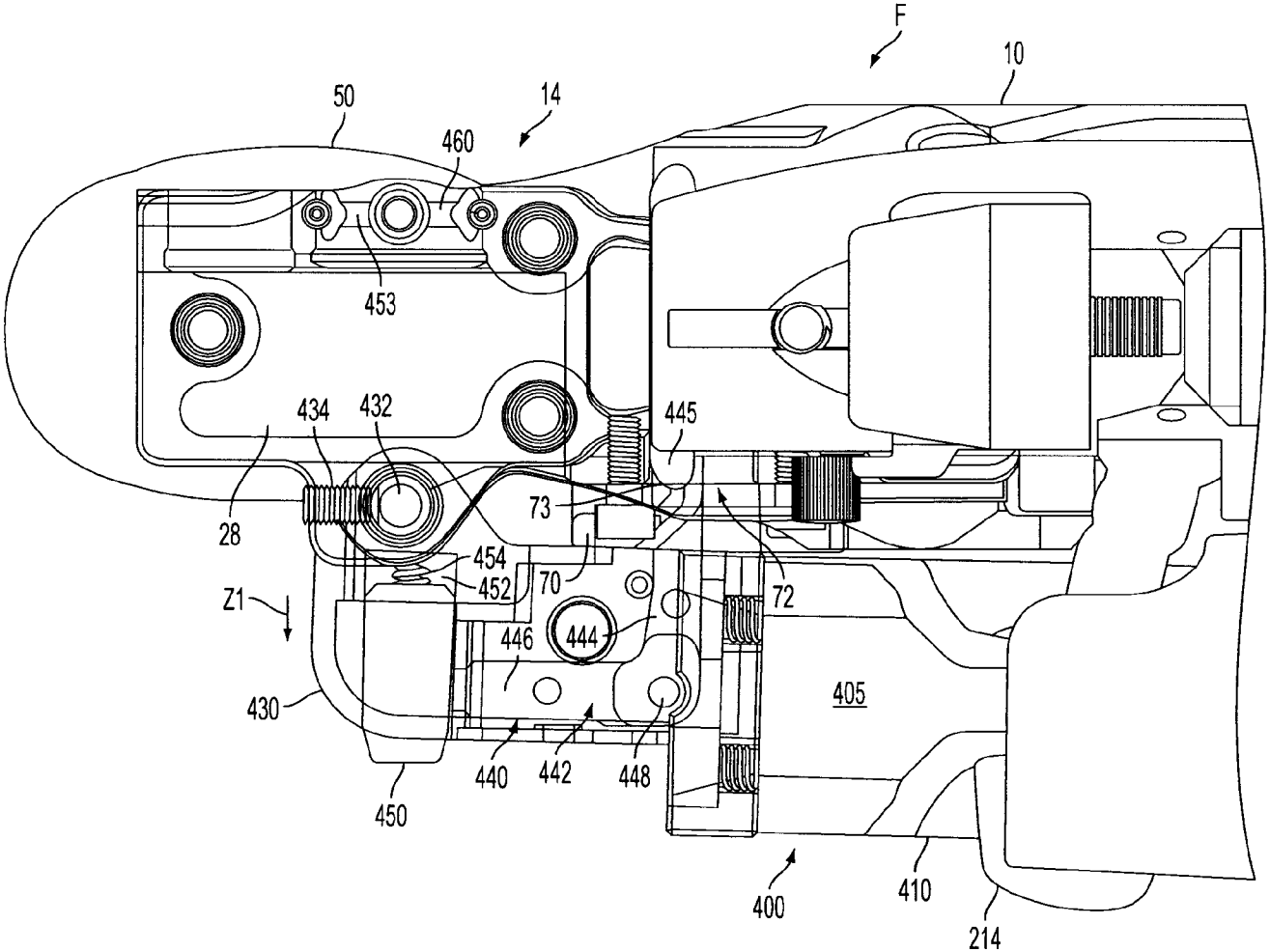
Figure 12:
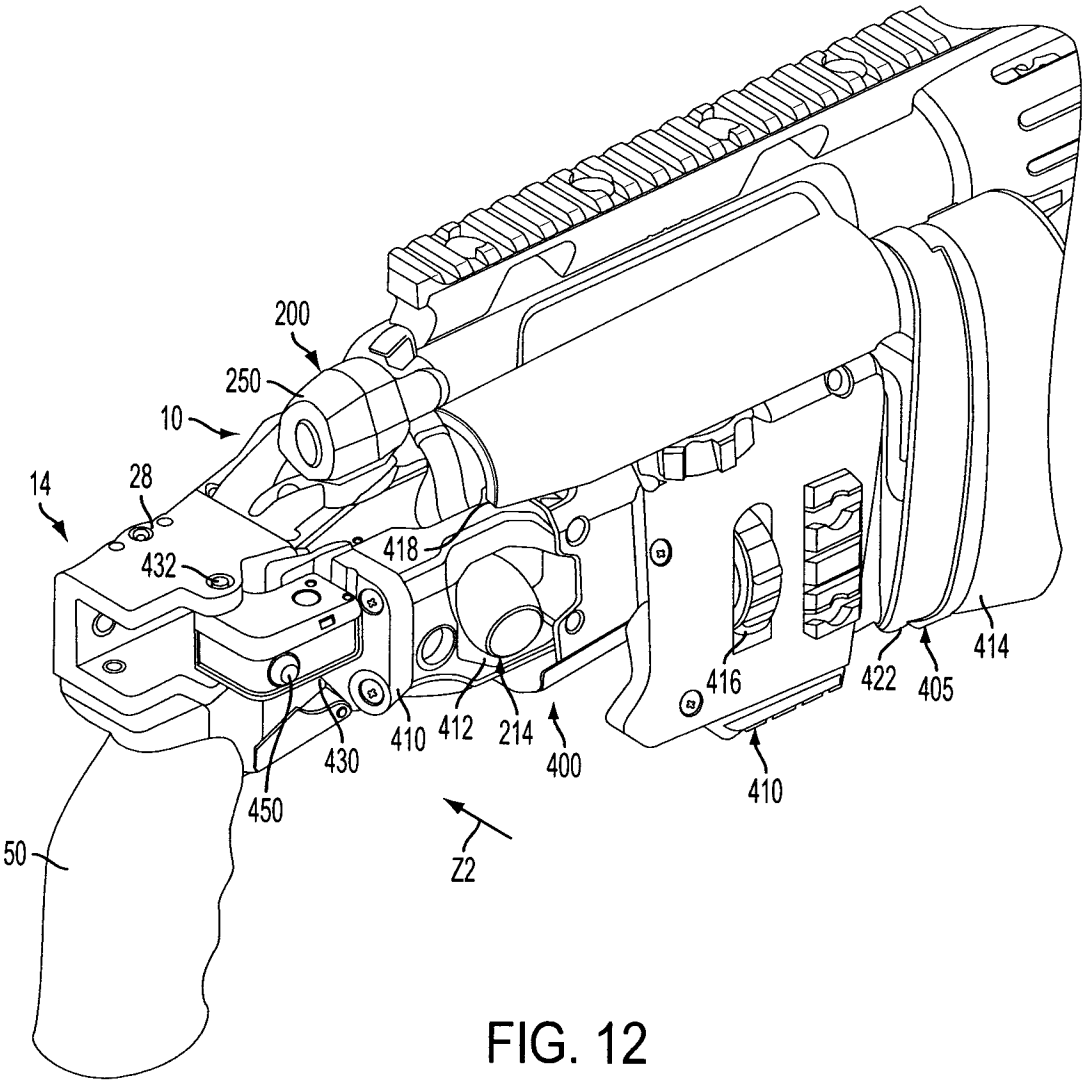
FIG. 12 is a perspective view of the butt stock in a folded position.

FIGS. 11A-11C illustrate a latch mechanism 440 for the foldable butt stock assembly 400, which is operable to selectively enable pivoting of the butt stock assembly 400 between an extended configuration (FIGS. 1 and 11A) and a folded configuration (FIGS. 11C and 12). In the extended position, the butt stock assembly 400 extends rearwardly from the rear end 14 of the chassis 10, in line with the chassis 10 (FIGS. 1 and 11A), enabling the firearm to be operated. In the folded configuration, the butt stock assembly 400 extends forwardly from the rear end 14 of the chassis 10, substantially parallel to the chassis 10, and is secured to a lateral side of the chassis 10, thereby reducing the length of the firearm F to facilitate transporting the firearm.

As shown in FIGS. 11A-11B, the latch mechanism 440 generally includes a substantially L-shaped, pivotable latch arm 442 having a first arm portion 444 extending transversely to the longitudinal axis X of the firearm F/butt stock assembly 400, a second arm portion 446 extending from the first arm portion 444 in a direction substantially perpendicular thereto along the axis X, and a pivot pin 448 provided at a junction of the first and second arm portions 444, 446. A detent element or boss 450 is connected to a free end of the second arm portion 446 and extends substantially perpendicular thereto. The first arm portion 444 is partially housed within the hinge member 430 and has a free end protruding from a side of the hinge member 430 and terminating at a tab 445. The second arm portion 446 extends within the hinge member 430. The boss 450 is disposed within a transverse bore 452 in the hinge member 430 and is selectively received within a locking opening pocket 453 mounted to the hinge member 430 and positioned laterally opposite the hinge pin 432. A biasing spring 454 located within the bore 452 biases the boss 450 in the lateral direction indicated by the arrow Z1. When the butt stock assembly 400 is in the extended position shown in FIGS. 1 and 11A, the locking pocket 46 is aligned with the transverse bore 452 and the boss 450 is retained in a locking opening or pocket 453 under the biasing force of the spring 454. Thus, the boss 450 locks the butt stock assembly 400 and the chassis 10 together such that the butt stock assembly 400 cannot be pivoted with respect to the chassis 10.

FIGS. 11B-12 illustrate a process for pivoting the butt stock assembly 400 from the extended configuration of FIGS. 1 and 11A to the folded configuration of FIGS. 11C-12. As shown in FIG. 11A, the butt stock assembly 400 can be unlocked from the chassis 10 by moving the tab 445 in the rearward direction of the firearm as indicated by the arrow L2 which causes the latch arm 442 to pivot clockwise about the pivot pin 448, in the direction indicated by the arrow P1. As a result, the boss 450 is moved against the biasing force of the spring 454 in the lateral direction indicated by the arrow Z2, and is removed from the locking pocket 453, thereby unlocking the butt stock assembly 400 from the chassis 10. Thereafter, as shown in FIGS. 11B-11C, the butt stock assembly 400 can be pivoted counterclockwise about the hinge pin 432, in the direction indicated by the arrow P2 at the hinge 432. Once the butt stock 200 is pivoted in the direction P2 to a point at which the boss 450 is out of alignment with the locking pocket 453, the tab 445 may be released, causing the boss to be moved in the direction Z1 under the biasing force of the spring 454, and thereby causing the lever arm 442 to be pivoted counterclockwise in the direction P2 under the biasing force of the spring 454. The butt stock 400 then may be pivoted until the butt stock is positioned adjacent the chassis 10 and extends substantially parallel thereto (FIG. 12).

When the butt stock assembly 400 is positioned in this folded configuration or manner, the tab 445 lockingly engages a locking feature located on the sidewall of the chassis 10 adjacent the butt stock assembly 400, shown in FIG. 11C as including, for example, a locking plate 70, thereby securing the butt stock assembly 400 in the folded position. Specifically, the tab 445 lockingly engages an edge 73 of an opening 72 in the locking plate 70 or other, similar locking feature as will be understood by those skilled in the art. As shown in FIGS. 11C and 12, when the butt stock assembly 400 is secured in the folded position, the bolt handle 214 extends through and is retained within the bolt handle opening 412, thereby preventing movement and operation of the bolt assembly 200. Additionally, when the butt stock assembly 400 is in its folded position, the boss 450 protrudes from the firearm F through the transverse bore 452, as indicated in FIG. 12. The tab 445 can be released from locking engagement with the edge 73 of the locking plate 70 by pressing the boss 450 against the biasing force of the spring 454 in the direction indicated by the arrow Z2, which causes the latch arm 442 to pivot clockwise in the as indicated by the arrow P1. Thereafter, the butt stock assembly 400 can be pivoted clockwise about the hinge pin 432 in the direction P1 and the boss 450 can be released and allowed to move in the direction Z1 under the biasing force of the spring 454. The butt stock assembly 400 can then be pivoted in the direction P1 until the butt stock assembly 400 is secured in its extended position, as described above with respect to FIGS. 1 and 11A.

As indicated in FIGS. 11A-11B, the locking opening or pocket 453 retains the boss 450 until the force of the spring 454 is overcome by rotation of the butt stock assembly, and generally is aligned with the boss 450 when the stock is in its extended position. The position and/or alignment of the pocket 453 further can be adjusted as needed to accommodate changes in the butt stock assembly. As indicated in FIGS. 11A-11C, a locking set screw or similar locking member 460 can be located just above the locking opening or pocket 453 to secure the position thereof with respect to the boss 450 when the butt stock assembly is in its extended position. When this set screw is loosened, 453 can be rotated and thereby taking the "slop" or variance out of the union between the lower stock assembly and the buttstock assembly. The receiving bore of the locking pocket 453 also is generally eccentrically shaped, and rotating the pocket, which thus rotates the receiving bore with respect to the boss 450, tightens up the interaction between the receiving bore of the locking pocket 453 and the boss 450 to help ensure secure and constant engagement of the boss 450 within the receiving bore of the locking pocket 453 to lock the stock in its extended position. Once the desired adjustment of the locking pocket is made, the set screw 460 can be tightened to secure or fix the locking pocket 453 in place.

Figure 13:
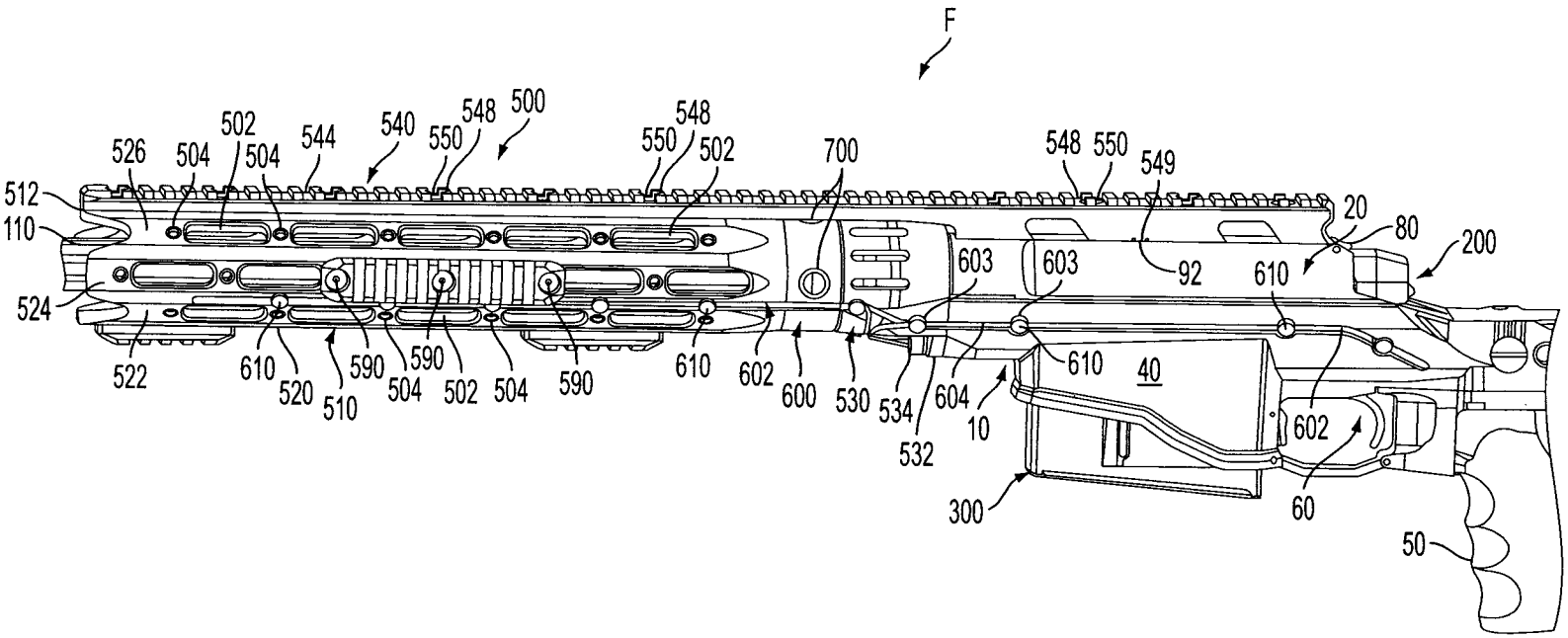
FIG. 13 is a side view showing a modular hand guard assembly and cable management system for use with the modular firearm, according to an embodiment.
Figure 14:
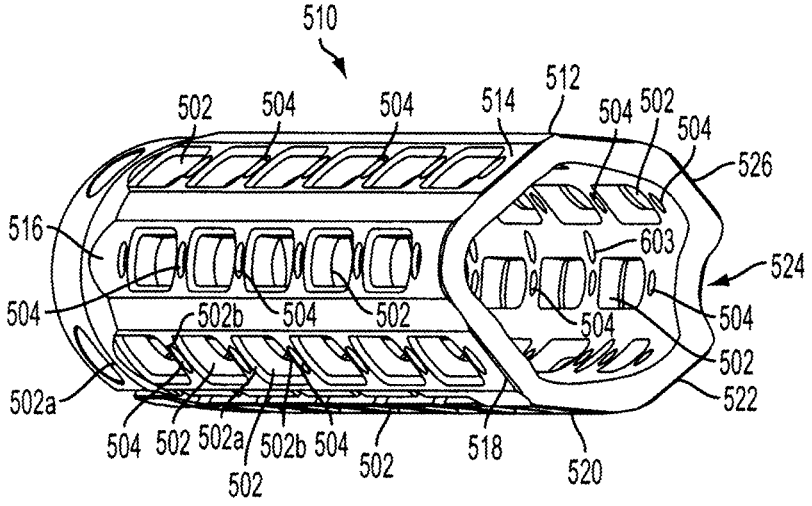
FIG. 14 is a perspective view of a hand guard of the hand guard assembly.

FIGS. 1 and 13-15 show features of the hand guard assembly 500. As shown in FIGS. 13 and 14, the hand guard assembly 500 includes a substantially tubular hand guard 510 defining a plurality of rail mounting platforms and a substantially tubular hand guard connector 530 for connecting the hand guard 510 to the front end 12 of the chassis 10. According to the exemplary embodiment illustrated herein, the hand guard 510 defines eight rail mounting platforms including a top platform 512, side platforms 514, 516, 518, a bottom platform 520, and side platforms 522, 524, 526, with each platform being disposed in a separate plane. Accordingly, the hand guard 510 has an octagonal cross-sectional shape in a plane transverse to the longitudinal axis of the hand guard assembly 500. Each platform 512, 514, 516, 518, 520, 522, 524, 526 includes a plurality of longitudinally spaced vent holes or openings 502 for venting heat from the barrel 110, and a plurality of longitudinally spaced mounting holes 504 for connecting accessory mounting rails 560, 580 to the hand guard 510. In the embodiment shown, the vent holes 502 are substantially oval in shape, and are positioned along the length of the hand guard 510 in alternating arrangement with the mounting holes 504. However, one skilled in the art will understand that other configurations of vent holes and mounting holes are possible.

Figure 15:
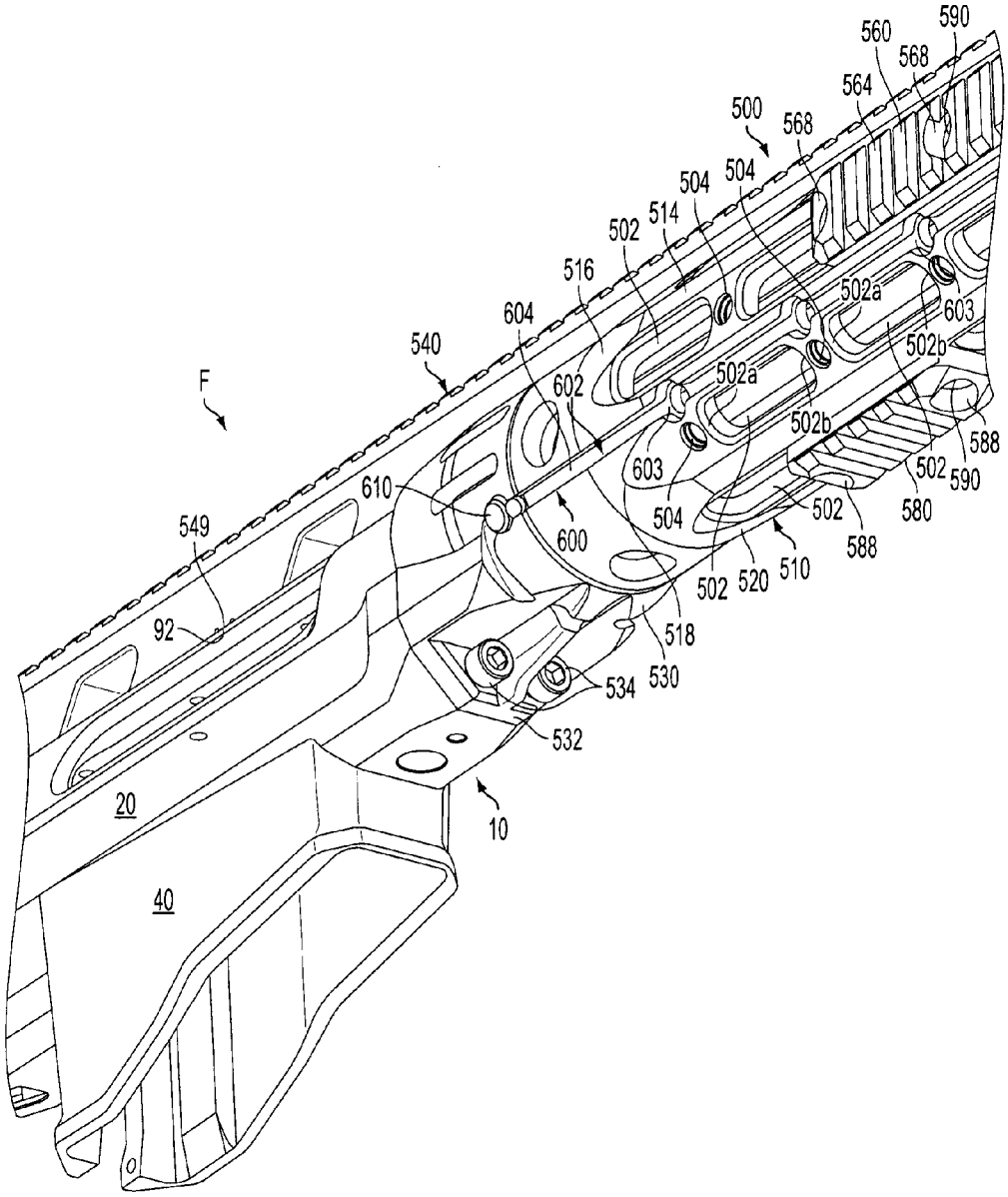
FIG. 15 is a bottom perspective view showing the connection of the hand guard assembly to a receiver of the modular firearm.
Figure 16:
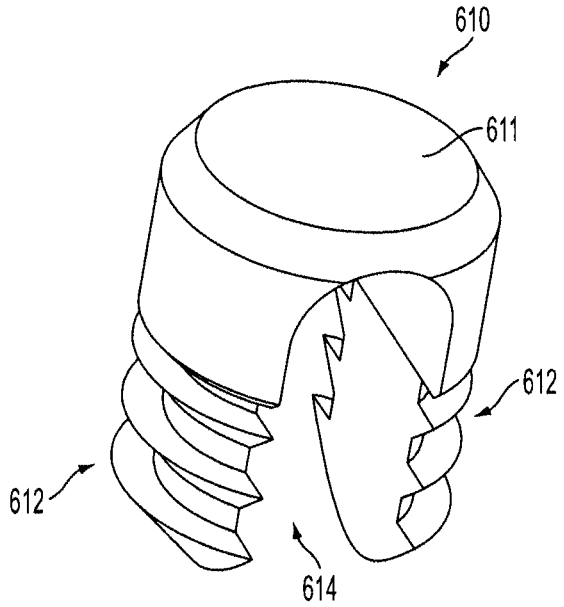
FIG. 16 shows a retaining clip of the cable management system.

As shown in FIGS. 13 and 15, the hand guard connector 530 can be formed integrally with or connected to a rear end of the platforms 512, 314, 516, 518, 520, 522, 524, 526, and includes a flange 532 for connecting the hand guard 510 to the chassis 10. The flange 532 is formed at a lower portion of the hand guard connector 530, and the hand guard connector 532 can be connected to a lower portion of the front end 12 of the chassis 10 with fasteners, such as bolts or screws 534, inserted through the flange 532.

As also shown in FIGS. 13 and 15, a top accessory mounting rail 540 for mounting accessories to the firearm F is provided on the top platform 512 (at the 12 o'clock position) of the hand guard 510. The top rail 540 can be adjustable and can be a replaceable Mil. Std. 1913 rail, for example. Referring to FIG. 22, the top rail 540 includes a top surface 544 for interfacing with an accessory (not shown) such as a scope or other optic device, a bottom surface 546 for interfacing with the top platform 512. A plurality of mounting holes 548 extend through the top and bottom surfaces 544, 546 for mounting the top rail 540 to the top platform 512. At least one recoil absorbing lug 549 extends from the bottom surface 546 of the top rail 540 at a rear section thereof. Each recoil absorbing lug 549 can be integrally formed with the bottom surface of the top rail 540 or with an associated platform of the hand guard assembly, or can be separately insertable into or engageable with the top rail and/or an associated platform. As shown in FIG. 19, the top rail 540 can be secured to the hand guard 510 by aligning mounting holes 548 with corresponding mounting holes 504 in the top platform 512 and corresponding mounting bores 90 (shown in FIG. 2) in the receiver 20, aligning each and inserting fasteners such as threaded fasteners 550 through aligned mounting holes 548, 504 and aligned mounting holes and bores 548, 90. The recoil absorbing lug can engage a recess in the top of the receiver 20, for seating the lug and helping secure the accessory mounting rail to the receiver. The rail 540 further can be a substantially continuous long rail so as to ensure that all optics and/or accessories mounted on the top rail are planarly aligned.

Each of the remaining platforms 512, 514, 516, 518, 520, 522, 524, 526 may have one or more accessory mounting rails, such accessory mounting rails 360, 380, connected thereto for mounting accessories on the firearm F. The rails 360, 380 and any other mounting rails connected to the platforms 512, 314, 516, 518, 520, 522, 524, 526 can also be Mil. Std. 1913 rail sections. The rails 360, 380 may be constructed to be shorter in length than the platforms as shown, or they may be constructed to extend substantially the entire length of the platforms 512, 514, 516, 518, 520, 522, 524, 526.

Referring to FIGS. 14 and 15, the rails 560, 580 each include a top surface 564, 584 for interfacing with an accessory, a bottom surface 566, 580 for interfacing with one of the platforms 514, 516, 518, 520, 522, 524, 526, a plurality of mounting holes 568, 588, and one or more recoil absorbing lugs 590 received within the Mounting holes 588 formed in the rail surfaces. The Mounting holes 568, 588 are configured to be aligned with corresponding mounting holes 504 in one of the platforms 514, 516, 518, 520, 522, 524, 526. The recoil absorbing lugs 569, 589 also can be formed integrally with the bottom surfaces 566, 586 or the rails or can be inserted into the rail and platform(s) of the hand guard assembly. The recoil absorbing lugs 569 of the rail 560 are spaced such that they are configured to engage a rear edge 502*a* and a front edge 502*b* of the same vent hole 502. The recoil absorbing lugs 569 of the rail 560 are spaced such that they are configured to engage a rear edge 502*a* of one vent hole 502 and a front edge 502*b* of another vent hole 502.

Thus, a rail section 360 or 380 can be secured to the hand guard 510 by inserting the pair of lugs 569 or 589 in one or more vent holes, and/or by aligning each mounting hole 568 or 588 with a corresponding mounting hole 504, and inserting fasteners such as threaded fasteners 570 through aligned mounting holes 568 and 504 or aligned mounting holes 588 and 504.

By way of example, a scope (not shown) or other optic can be attached to the top rail 540 and/or a bipod (not shown) can be attached to a bottom rail section 350. However, because each platform 514, 516, 518, 520, 522, 524, 526 is positioned in its own plane and includes a plurality of mounting holes 502, rails of different sizes and/or configurations can be mounted at various positions and in various configurations and numbers along the length of each platform, thereby enabling various types and combinations of accessories to be mounted on the hand guard 510. Furthermore, it should be understood that the accessory mounting rails 560, 580 can be mounted on other surfaces of the firearm F, such as, but not limited to the butt stock 410 (FIG. 1).

Due to the manner in which the hand guard assembly 500 is connected to the chassis 10/receiver 20, the hand guard assembly 500 surrounds the barrel 110, but is not directly connected to the barrel 110. Because the hand guard assembly 500 is not directly connected to the barrel 110, the hand guard 510 is substantially free-floating with respect to the barrel, thereby improving accuracy in operating the firearm F. The recoil absorbing lugs 549, 569, 589 absorb recoil forces generated by firing the firearm F and thereby resist shearing of accessories mounted on respective rails 540, 560, 580.

In addition, radially located sling swivel cups, such as indicated at 700 in FIG. 13, can be attached adjacent the fore-end and the butt stock of the firearm F. There typically can be four sling swivel cups, although more or fewer sling swivel cups also can be used. One to three of these sling swivel cups can be used to attach carrying slings to the weapon via a push-fit sling swivel. The chassis 10 and the buttstock body 400 also can include one or more of such sling swivel cups for attaching an opposite end of the carrying sling thereto.

Certain electronic accessories, such as optics, which can be attached to the firearm F by mounting on the hand guard 510 or other parts of the firearm F, often require wire or cable connections in or on the firearm. Thus, as illustrated in FIGS. 13 and 15, the firearm F can include a wire management system 600 including one or more wire channels 602 integrated in exterior walls of the chassis 10, the hand guard 510, and/or the hand guard connector 530. One or more wires or cables 604 can be placed in the channel(s) 600 and routed to components and/or accessories in and/or on the firearm F. The wire(s) 604 can be secured in the channel(s) 600 by retaining clips 610 inserted into openings 601 the channel(s) 600. Each retaining clip 610 (FIG. 16) can include a top 611 and a pair of deformable ribbed arms 612 defining a passage 614 therebetween sized to receive a wire 604. The ribbed arms 612 can be configured to engage an opening 601 by a press-in fit. To secure a wire 604 (FIG. 13) in a channel 602, the wire 604 can be inserted through the passage 614 of one or more clips 610, and the each clip 610 can be pressed into an opening 601 in the channel 602. When a clip 610 is pressed into an opening 601, the ribbed arms are deformed towards each other and, as a result, engage the wire 604 by an interference fit.

The foregoing disclosure provides illustrative embodiments of the invention and is not intended to be limiting. It should be understood that modifications of the disclosed embodiments are possible within the spirit and scope of the invention, and the invention should be construed to encompass such modifications.

What is claimed is:

1. A modular firearm system, comprising:

a receiver;

an interchangeable barrel assembly mountable to the receiver and including a barrel defining a chamber adapted to receive a round of ammunition therein;

a fire control for firing the round of ammunition;

a reconfigurable magazine adapted to supply ammunition of different sizes and/or calibers to the chamber; and a bolt assembly received within and movable along the receiver, the bolt assembly including a bolt body having an axial bore extending therethrough and an interchangeable bolt head releasably mountable within the bolt body, and comprising an axially extending ejector mounting bore in which an ejector is received, the ejector being movable through the bolt head for rejection of a spent cartridge;

wherein the barrel can be exchanged for a barrel having a chamber adapted to receive ammunition of a different size and/or caliber, the bolt head removed from the bolt body and replaced with a bolt head adapted to engage the ammunition of a different size and/or caliber, and the magazine reconfigured to supply the ammunition of a different size and/or caliber to effect a change in size and/or caliber of the ammunition to be fired by the firearm.

2. The modular firearm system of claim 1, further comprising a transverse bore formed in the bolt body, and a locking member received in the bore and engaging the bolt head for releasably securing the bolt head to the bolt body.

3. The modular firearm system of claim 2, wherein the locking member further comprises an axial bore formed through at least a portion of the locking member for enabling passage of a firing pin therethrough.

4. The modular firearm system of claim 1, further comprising a bolt stop mounted at a rear portion of the receiver, the bolt stop including a bolt stop lever movable between first and second positions for engaging and guiding a linear movement of the bolt assembly and selectively limiting movement of the bolt assembly.

5. The modular firearm system of claim 4, wherein the bolt body includes a guide channel, and wherein the bolt stop lever further comprises a guide arm adapted to engage the bolt body along the guide channel thereof.

6. The modular firearm system of claim 1, wherein the bolt head comprises a sidewall with one or more radially projecting locking lugs adjacent a front end of the bolt head.

7. The modular firearm system of claim 6 wherein the interchangeable barrel includes a barrel extension connected to a rear end of the interchangeable barrel; the barrel extension including one or more recess portions projecting radially outwardly from and spaced about the central bore of the barrel extension, and a locking aperture with a central bore that communicates with a bore in the interchangeable barrel.

8. The modular firearm system of claim 7, wherein the interchangeable bolt head includes at least one axially extending extractor mounting channel, at least one transverse pivot pin bore intersecting the extractor mounting channel, and at least one extractor pivotally mounted along the at least one extractor mounting channel by engagement of the extractor with a pivot pin inserted through the transverse pivot pin bores.

9. The modular firearm system of claim 7, wherein the one or more locking lugs of the bolt head are configured to selectively engage the locking aperture of the barrel extension for securing the bolt head in place during firing of the firearm.

10. The modular firearm system of claim 9, wherein the bolt head further comprises an ejector spring coaxially positioned with the ejector along the ejector mounting bore, and configured to move the ejector forwardly for ejection of the spent round of ammunition.

11. A modular firearm system, comprising:

a receiver;

an interchangeable barrel assembly mountable to the receiver and including a barrel having a bore and defining a chamber configured to receive a round of ammunition of a selected caliber therein, and a barrel extension at a rear end of the barrel, the barrel extension including a central bore that communicates with the bore of the barrel, and one or more recess portions projecting radially outwardly from and spaced about the central bore of the barrel extension;

a fire control for firing the round of ammunition;

a magazine adapted to supply ammunition of the selected caliber to the chamber; and a bolt assembly received within and movable along the receiver, the bolt assembly including a bolt body having an axial bore extending therethrough and an interchangeable bolt head releasably mountable within the bolt body, the interchangeable bolt head including an axially extending extractor mounting channel and an extractor received along the extractor mounting channel and pivotally mounted to the bolt head by engagement of the extractor with a pivot pin received within the bolt head, an ejector mounted within the bolt head, and one or more radially projecting locking lugs located adjacent a front end of the bolt head;

wherein the barrel can be exchanged for a barrel having a chamber configured to receive ammunition of a different size and/or caliber, the bolt head removed from the bolt body and replaced with a bolt head adapted to engage the ammunition of a different size and/or caliber, and the magazine replaced or reconfigured to supply the ammunition of a different size and/or caliber to effect a change in size and/or caliber of the ammunition to be fired by the firearm.

* * * * *